US006672287B2

(12) United States Patent
Wada et al.

(10) Patent No.: US 6,672,287 B2
(45) Date of Patent: Jan. 6, 2004

(54) FUEL RAIL/FUEL CONDUIT CONNECTING STRUCTURE IN ENGINE OF OUTBOARD ENGINE SYSTEM

(75) Inventors: Tetsu Wada, Saitama (JP); Tomonori Ikuma, Saitama (JP); Sadafumi Shidara, Saitama (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 38 days.

(21) Appl. No.: 10/144,758

(22) Filed: May 15, 2002

(65) Prior Publication Data

US 2002/0185110 A1 Dec. 12, 2002

(30) Foreign Application Priority Data

May 15, 2001 (JP) ..... 2001-145419

(51) Int. Cl.[7] ..... F02M 37/04
(52) U.S. Cl. ..... 123/468; 123/469; 123/456
(58) Field of Search ..... 123/456, 468, 123/469

(56) References Cited

U.S. PATENT DOCUMENTS 3,929,109 A * 12/1975 Chamberlain ..... 123/456
4,474,159 A * 10/1984 Katnik ..... 123/468
5,261,608 A * 11/1993 Hatzis et al. ..... 123/469
5,983,864 A * 11/1999 Chockley et al. ..... 123/470
6,460,511 B2 * 10/2002 Kato ..... 123/468

FOREIGN PATENT DOCUMENTS

JP 2000-34934 2/2000

* cited by examiner

*Primary Examiner*—Thomas N. Moulis
(74) *Attorney, Agent, or Firm*—Arent Fox Kintner Plotkin & Kahn

(57) ABSTRACT

In fuel rail/fuel conduit connecting structure in an engine for an outboard engine system, a first connecting bore opens into an end face of a fuel rail, and a second connecting bore opens into an end face of a terminal member having a connecting pipe portion which is projectingly provided on one side thereof and to which an end of the fuel conduit is connected. One of halves of a joint collar is fitted to an inner peripheral surface of the first connecting bore with a first seal member interposed therebetween, and the other half of the joint collar is fitted to an inner peripheral surface of the second connecting bore with a second seal member interposed therebetween. Thus, it is possible to connect the fuel rails and the fuel conduits to each other, while providing reduction in number of parts and number of assembling steps for the connecting structure and moreover, the connecting structure is excellent in corrosion resistance.

2 Claims, 20 Drawing Sheets

FUEL RAIL/FUEL CONDUIT CONNECTING STRUCTURE IN ENGINE OF OUTBOARD ENGINE SYSTEM

BACKGROUND OF THE INVENTION

1. Field of the Invention

The present invention relates to an improvement in a fuel rail/fuel conduit connecting structure in an engine for an outboard engine system, in which fuel rails mounted to a plurality of fuel injection valves in the engine for the outboard engine system are connected with fuel conduits for delivering and receiving fuel to and from the fuel rails in order to dispense the fuel to the fuel injection valves in the engine.

2. Description of the Related Art

A conventional fuel rail/fuel conduit connecting structure in an engine for an outboard engine system is already known, as disclosed, for example, in Japanese Patent Application Laid-open No. 2000-34934.

In the fuel rail/fuel conduit connecting structure disclosed in the above Japanese Patent Application Laid-open No. 2000-34934, a connecting flange of a joint connected to the fuel conduit is secured by a pair of bolts to a side of the fuel rail into which a fuel port opens, whereby the inside of the joint is put into communication with the fuel port. This structure is accompanied by the following disadvantage: An end of a fuel passage opening into an end face of the fuel rail must be occluded by a special blind plug and moreover, the two bolts are required to secure the joint to the fuel rail. Therefore, the number of parts and the number of assembling steps are increased, and it is difficult to reduce the cost.

SUMMARY OF THE INVENTION

Accordingly, it is an object of the present invention to provide a fuel rail/fuel conduit connecting structure in an engine for an outboard engine system, wherein the connection of the fuel rail and the fuel conduit can be carried out, while providing reductions in number of parts and number of assembling steps and moreover, the structure has excellent corrosion resistance.

To achieve the above object, according to a first aspect and feature of the present invention, there is provided a fuel rail/fuel conduit connecting structure in an engine for an outboard engine system, the structure providing a connection between: a fuel rail mounted to a plurality of fuel injection valves in the engine in order to dispense a fuel to the fuel injection valves; and fuel conduits for delivering and receiving the fuel to and from the fuel rail; wherein a first connecting bore opens into an end face of the fuel rail and leads to a fuel passage in the fuel rail, and a second connecting bore opens into an end face of a synthetic resin terminal member having a connecting pipe portion which is projectingly provided on one side of the terminal member and to which an end of the fuel conduit is connected, the second connecting bore leading to the inside of the connecting pipe portion; wherein one of halves of a joint collar is fitted to an inner peripheral surface of the first connecting bore with a first seal member interposed therebetween, and the other half of the joint collar is fitted to an inner peripheral surface of the second connecting bore with a second seal member interposed therebetween; and wherein the fuel rail and the fuel conduit are fastened to each other with their end faces aligned with each other by a single bolt.

The fuel conduits correspond to a communication pipe 112 and a third fuel conduit 123 in an embodiment of the present invention, which will be described hereinafter.

With such arrangement of the first feature, the terminal member fitted over the other half of the joint collar functions as a cap for covering an end face of each of the fuel rails and hence, a special closing member for occluding the fuel rails of the fuel rails as in the conventionally known structure is not required. In addition, the joint collar fitted into the first and second connecting bores not only permits each of the fuel rails and the terminal member to communicate with each other, but also prevents the rotation of the terminal member by cooperation with the single bolt and hence, the terminal member can be fastened to each of the fuel rails by the single bolt. Thus, it is possible to reduce the number of parts and the number of assembling steps for the connecting structure, leading to a reduction in cost.

In addition, the seal member is interposed between the outer peripheral surface of the joint collar and the inner peripheral surface of each of the first and second connecting bores and hence, even if there is a dislocation of the coaxial disposition of the first and second connecting bores, such dislocation can be absorbed by the deformation of the seal members to ensure the liquid tightness around the joint collar.

Further, the terminal member is made of a synthetic resin having a corrosion resistance and hence, even if seawater or the like is deposited to the terminal member, there is not a possibility that the terminal member is corroded.

According to a second aspect and feature of the present invention, in addition to the first feature, wherein a distance collar made of a metal is embedded in the terminal member, the bolt being inserted through the distance collar.

With such arrangement of the second feature, it is possible to firmly clamping the terminal member made of the synthetic resin to each of the fuel rails with a clamping force of the bolt shared by the distance collar.

The above and other objects, features and advantages of the invention will become apparent from the following description of the preferred embodiment taken in conjunction with the accompanying drawings.

DESCRIPTION OF THE PREFERRED EMBODIMENT

The present invention will now be described by way of an embodiment with reference to the accompanying drawings.

In the description made below, the terms "front", "rear", "left" and "right" are referred to with respect to a hull H to which an outboard engine system O is mounted.

Figure 1:
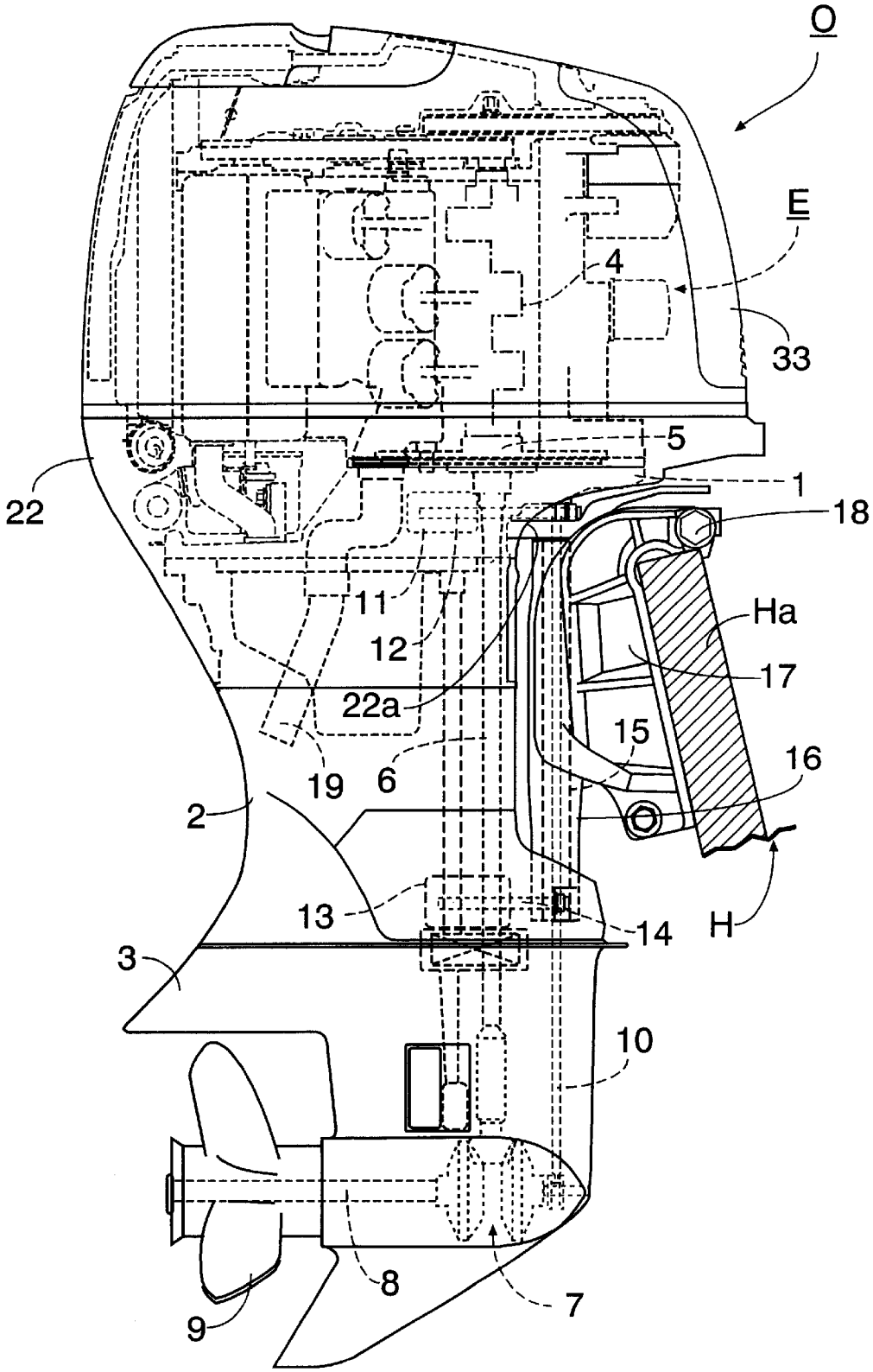
FIG. 1 is a side view of the entire arrangement of an outboard engine system.
Figure 2:
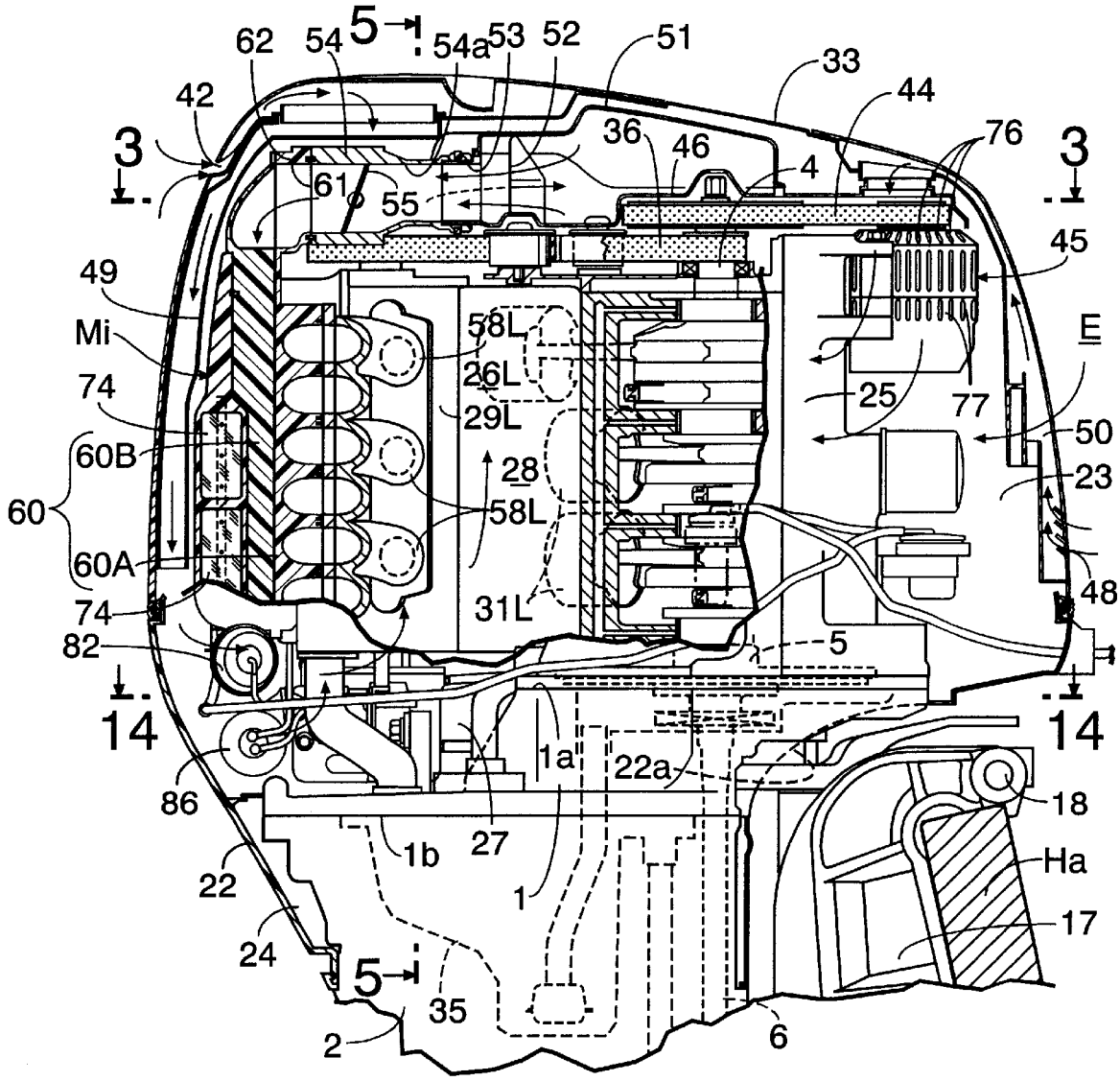
FIG. 2 is a vertical sectional view of essential portions of FIG. 1.

Referring to FIGS. 1 and 2, the outboard engine system O includes a mount case 1, an extension case 2 coupled to a lower end face of the mount case 1, and a gear case 3 coupled to a lower end face of the extension case 2. A V-type 6-cylinder and water-cooling 4-stroke engine E is mounted on an upper end face of the mount case 1 with a crankshaft 4 disposed vertically.

A drive shaft 6 is connected along with a flywheel 5 to a lower end of the crankshaft 4. The crankshaft 4 extends downwards within the extension case 2 and is connected at its lower end to a horizontal propeller shaft 8 through a forward/backward travel switchover mechanism 7 mounted within the gear case 3, and a propeller 9 is secured to a rear end of the propeller shaft 8. A change rod 10 is connected to a front portion of the forward/backward travel switchover mechanism 7 for operating the mechanism 7.

A swivel shaft 15 is fixed between a pair of left and right upper arms 12 connected to the mount case 1 through upper mount rubbers 11 and a pair of left and right lower arms 14 connected to the extension case 2 through lower mount rubbers 13. A swivel case 16 rotatably supporting the swivel shaft 15 is vertically swingably supported through a horizontal tilting shaft 18 on a stern bracket 17 mounted on a transom Ha of a hull H.

A bracket 20 is mounted on the mount case 1 through a plurality of stays 21 to surround a lower portion of the engine E, and an annular undercover 22 made of a synthetic resin is secured to the bracket 20. The undercover 22 covers the periphery of a section extending from the lower portion of the engine E to an upper portion of the extension case 2, and an engine hood 33 is detachably mounted at an upper end of the undercover 22 to cover the engine E from above. An engine room 23 for accommodation of the engine E is defined by the engine hood 33 and the undercover 22. An annular empty chamber 24 is defined between the undercover 22 and an outer peripheral surface of the upper portion of the extension case 2. The undercover 22 is provided at its front portion with a notch 22*a* adapted to open the empty chamber 24 into the atmospheric air, and the upper arms 12 are disposed through the notch 22*a*.

Figure 3:
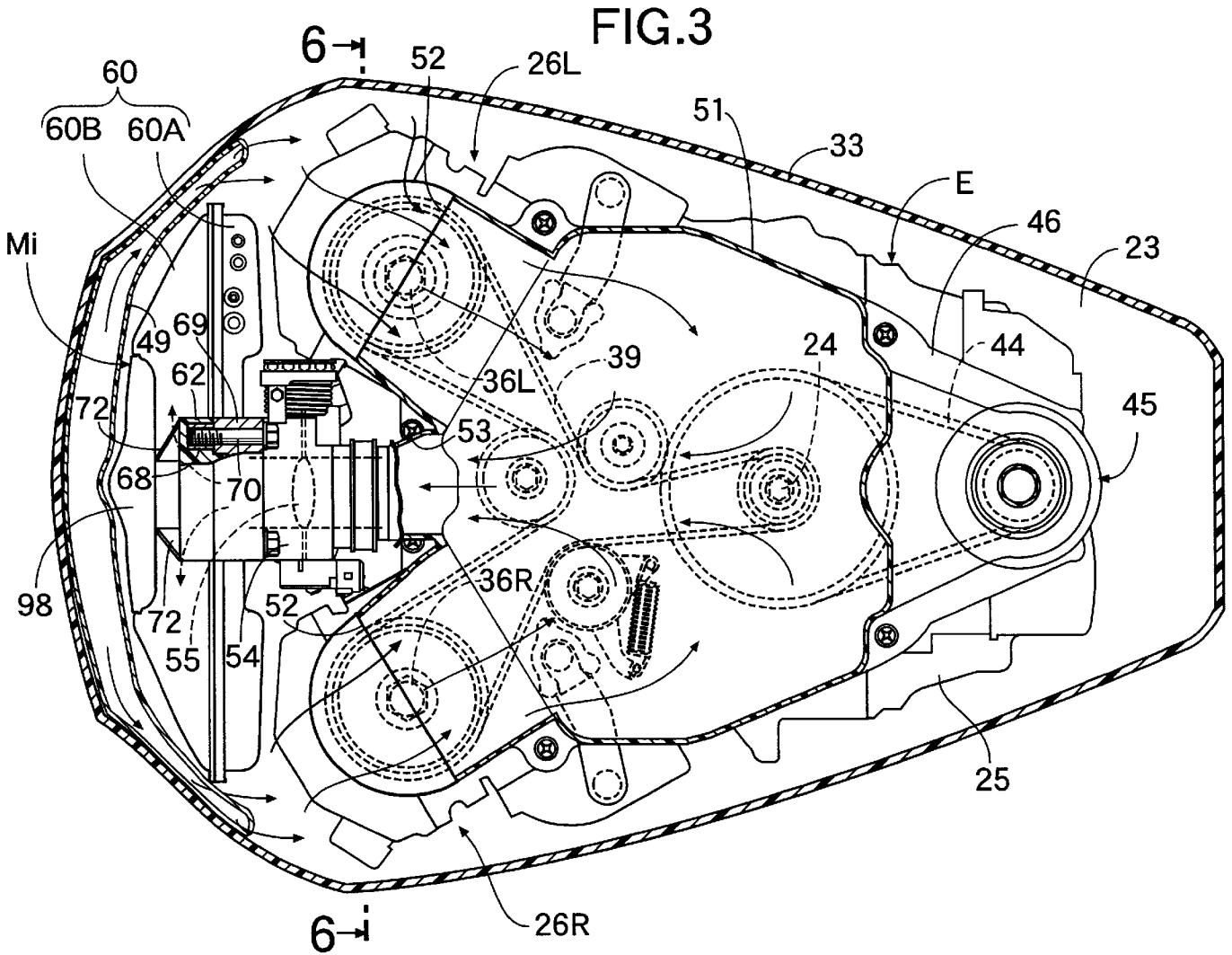
FIG. 3 is a sectional view taken along a line 2—2 in FIG. 2.
Figure 4:
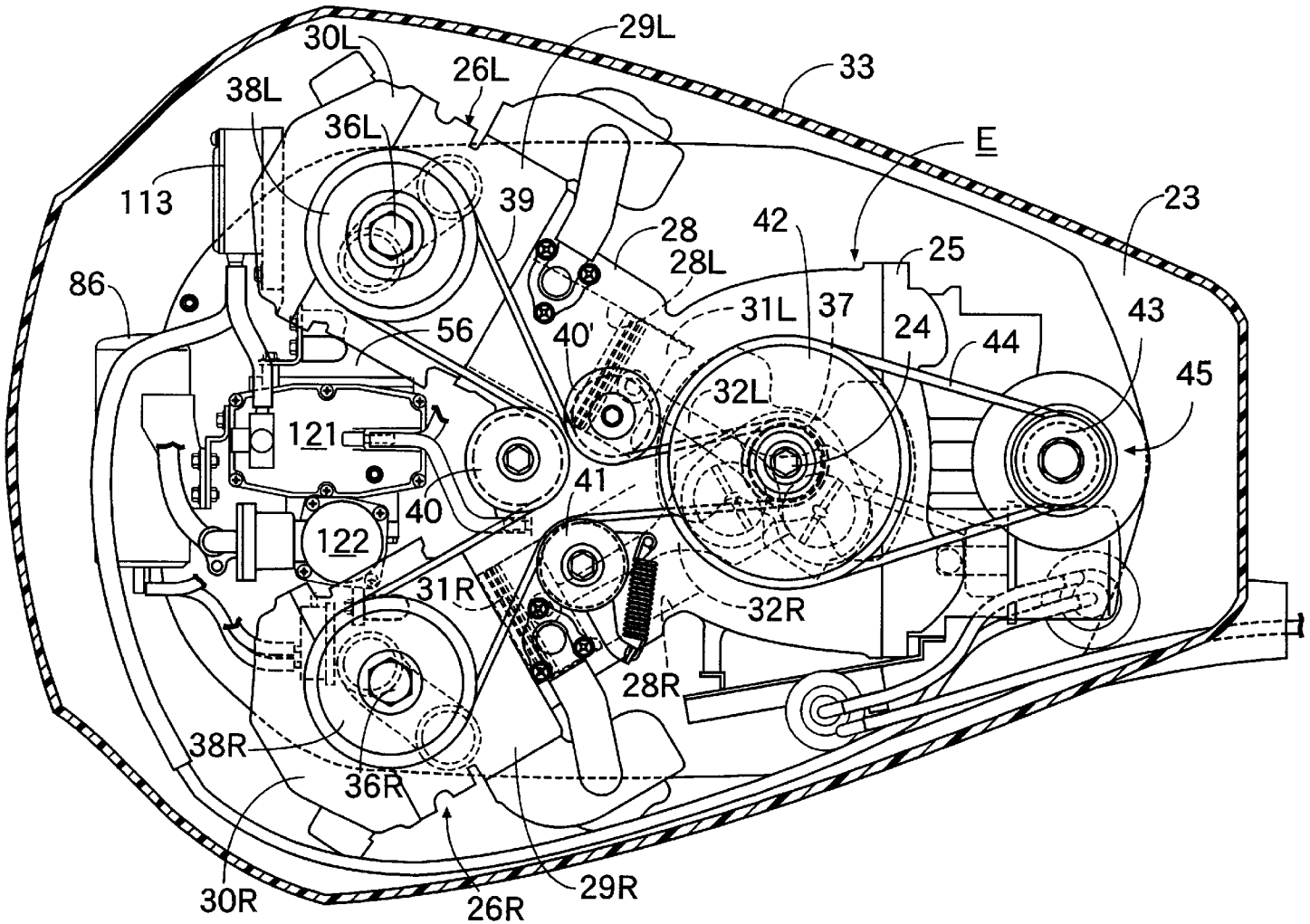
FIG. 4 is a plan view similar to FIG. 3, but showing a state with an intake system removed.

As shown in FIGS. 2 to 4, the engine E includes a crankcase 25 for supporting the crankshaft 4 disposed vertically, and a pair of left and right banks 26L and 26R spreading into a V-shape in a rearward direction from the crankcase 25. A lower surface of the crankcase 25 is bolted to a mounting face 1*a* (see FIG. 13) of an upper portion of the mount case 1. The lower surface of the crankcase 25 is formed at a level higher than an upper surface of the crankcase 1 and offset forwards, whereby an auxiliary-placing space 27 is defined between the left and right banks 26L and 26R and the mount case 1.

Figure 5:
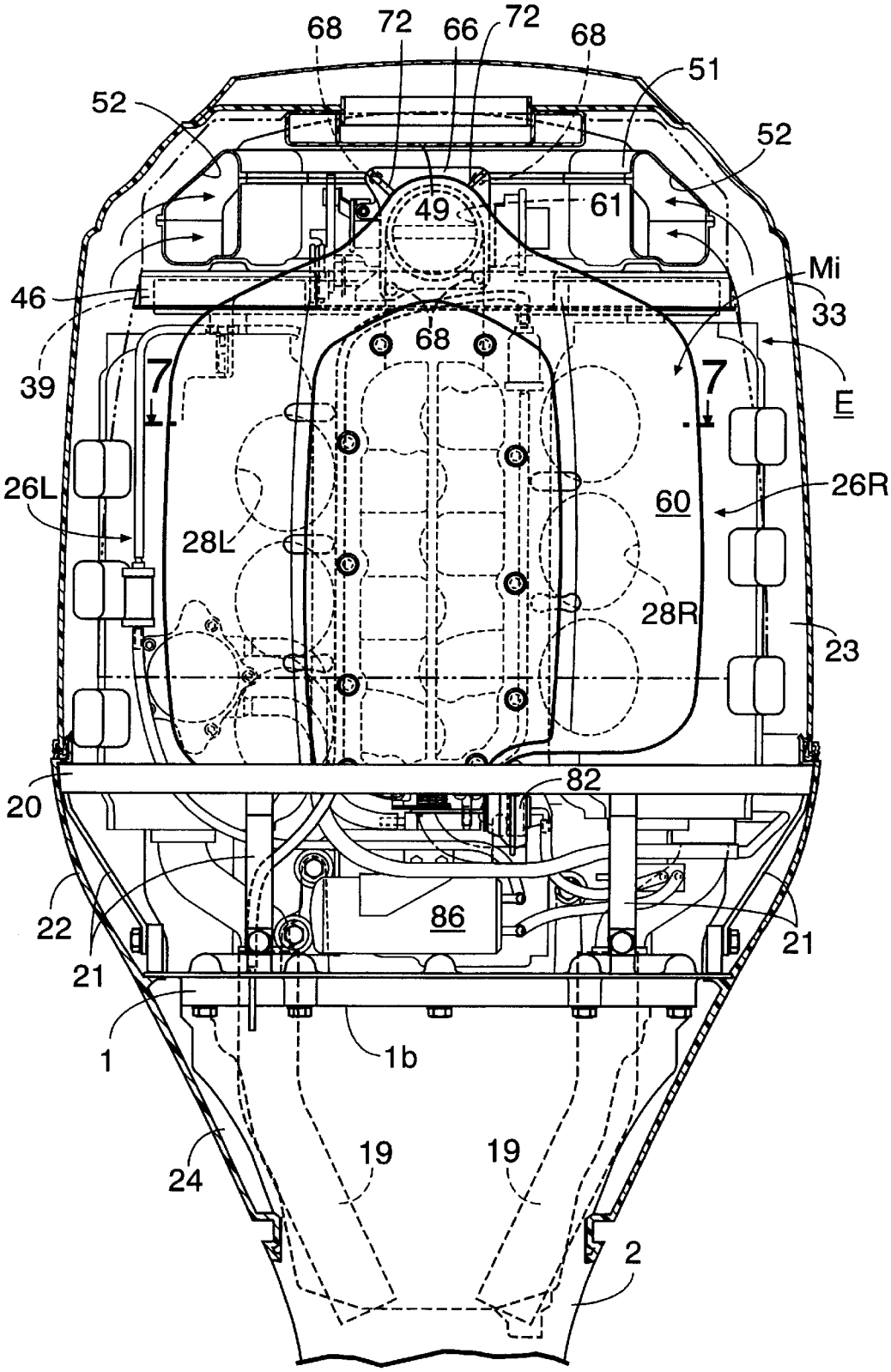
FIG. 5 is a sectional view taken along a line 5—5 in FIG. 2.
Figure 6:
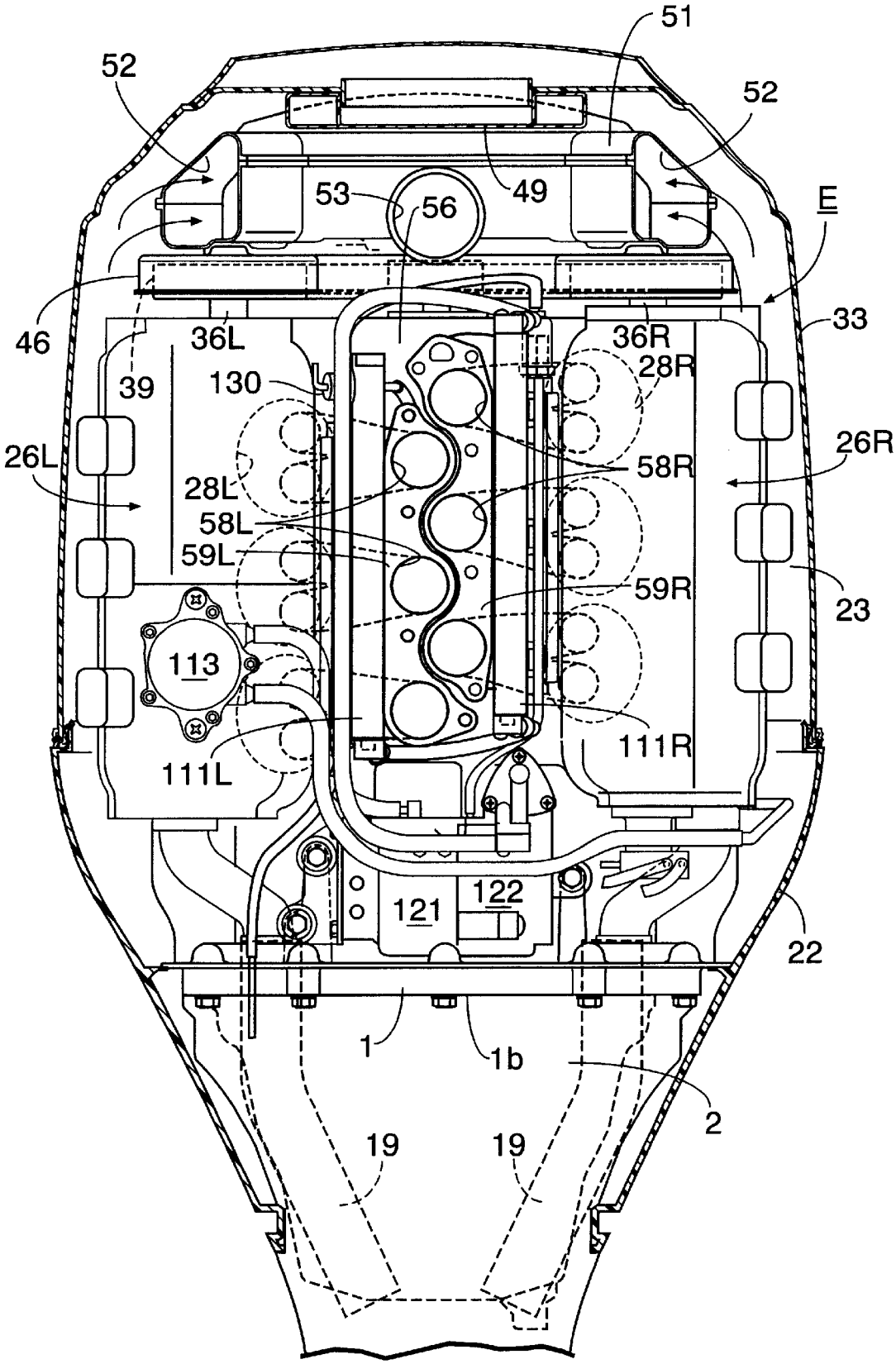
FIG. 6 is a sectional view taken along a line 6—6 in FIG. 3.

As shown in FIGS. 5 and 6, each of the banks 26L and 26R has a plurality of (three in the illustrated embodiment) cylinder bores 28L, 28R arranged vertically. The left and right banks 26L and 26R are comprised of a cylinder block 28 bolted to a rear end face of the crankcase 25 and having the cylinder bores 28L and 28R, a pair of cylinder heads 29L and 29R bolted to left and right rear end faces of the cylinder block 28 into which the cylinder bores 28L and 28R open, respectively, and a pair of head covers 30L and 30R coupled to rear end faces of the cylinder heads 29L and 29R to close valve-operating chambers defined in the cylinder heads 29L and 29R.

Referring to FIG. 4, pistons 31L and 31R slidably received in the cylinder bores 28L and 28R are connected to the crankshaft 4 through connecting rods 32L and 32R, respectively.

An oil pan 35 is disposed in the extension case 2 and coupled to a mounting face 1*b* of a lower portion of the mount case 1.

Valve-operating camshafts 36L and 36R are rotatably carried respectively in the left and right cylinder head 29L and 29R to extend in parallel to the crankshaft 4. A small-diameter first driving pulley 37 is secured to an upper end of the crankshaft 4, and follower pulleys 38L and 38R are secured to upper ends of the left and right camshafts 36L and 36R, respectively. A single timing belt 39 is reeved around the driving pulley 37, the follower pulleys 38L and 38R, so that the first driving pulley 37 drives the follower pulleys 38L and 38R and thus the camshafts 36L and 36R at a reduction ratio of 1/2 during rotation of the crankshaft 4. Idling pulleys 40 and 40' for guiding the timing belt 39 and a tensioner 41 for tensioning the timing belt 39, while guiding the timing belt 39, are disposed between the pulleys 37, 38L and 38R.

A large-diameter second driving pulley 42 is disposed coaxially just above the first driving pulley 37 and secured to the upper end of the crankshaft 4, and a driving belt 44 is reeved around the second driving pulley 42 and a follower pulley 43 of a generator 45 mounted to a front surface of the crankcase 25, so that the second driving pulley 42 drives the follower pulley 43 and thus the generator 45 at an increased speed during the rotation of the crankshaft 4.

As shown in FIGS. 2 and 3, a belt cover 46 for covering the timing belt 39 and the driving belt 44 from above is secured to upper surfaces of the cylinder block 28 and the crankcase 25.

Reference numeral 19 in FIG. 1 denotes an exhaust pipe leading to an exhaust port in the engine E. A downstream end of the exhaust pipe 19 opens into the extension case 2. An exhaust gas discharged from the exhaust pipe 19 into the extension case 2 is passed through a cavity of a boss portion of the propeller 9 and discharged into water.

An intake system for the engine E will be described with reference to FIGS. 2, 3 and 5 to 13.

Referring to FIGS. 2 and 3, a first air intake port 47 is provided in an upper portion of a rear surface of the engine hood 33, and a flat ventilating duct 49 is disposed along an inner surface of a rear wall of the engine hood 33 to communication with the first air intake port 47, so that its lower end opens into a lower portion of the engine room 23. A second air intake port 48 is provided in a lower portion of a front surface of the engine hood 33, and a partition wall 64 is mounted to an inner surface of a front wall of the engine hood 44 to define a ventilating passage 50 extending from the second air intake port 48 to an upper portion of the generator 45.

A box-shaped intake silencer 51 is connected to an upper surface of the belt cover 46 and utilizes a rear half of the upper surface of the belt cover 46 as a portion of a bottom wall. A pair of left and right inlets 52, 52 and an outlet 53 disposed between the inlets 52, 52 are provided in a rear wall of the intake silencer 51, and an upstream end of an intake passage 54*a* in a throttle body 54 is connected to the outlet 53. A throttle valve 55 is supported in the intake passage 54*a* and operable in association with an accelerator lever (not shown) mounted on the hull H.

Figure 7:
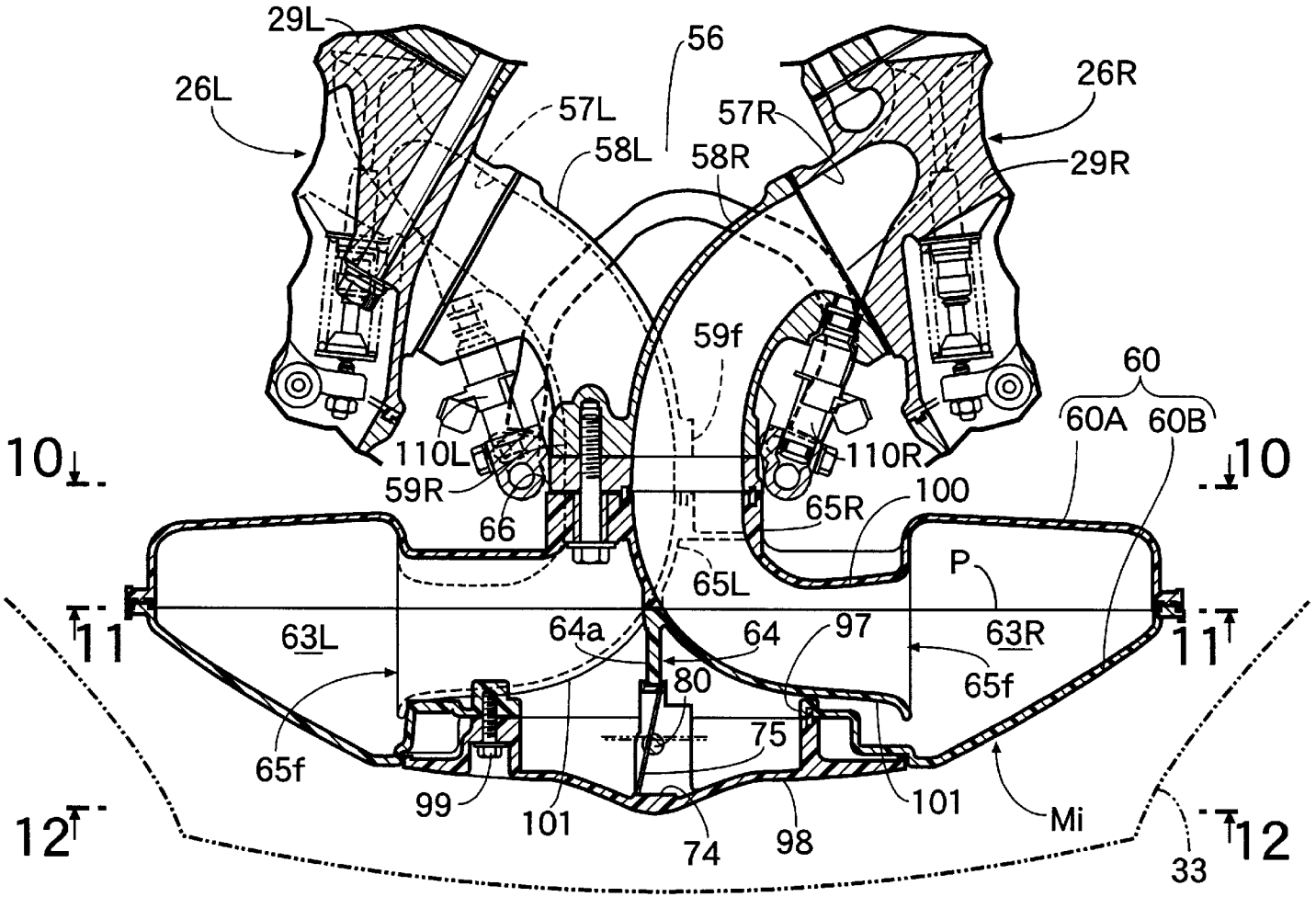
FIG. 7 is a sectional view taken along a line 7—7 in FIG. 5.

Referring to FIGS. 5 to 7, an intake manifold Mi is disposed to face a valley 56 between the left and right banks 26L and 26R, and to lead to a downstream end of the intake passage 54*a* in the throttle body 54. Disposed in the valley 56 are a plurality of left intake pipes 58L connected to a plurality of intake ports 57L defined in the cylinder head 29L of the left bank 26L, and a plurality of right intake pipes 58R connected to a plurality of intake ports 57R defined in the cylinder head 29R of the right bank 26R. The intake pipes 58L and 58R are disposed so that their upstream ends are directed rearwards. A left connecting flange 59L is integrally formed at the upstream ends of the left intake pipes 58L to connect them to one another, and a right connecting flange 59R is integrally formed at the upstream ends of the right intake pipes 58R to connect them to one another.

The intake manifold Mi includes an intake air-dispending box 60 made of a synthetic resin and having such a shape that it is prolonged vertically and flat in a longitudinal direction. The intake air-dispensing box 60 is disposed astride rear surfaces of the left and right banks 26L and 26R. A connecting flange 62 having an intake air inlet 61 at its central portion is formed at an upper portion of a front wall of the intake air-dispending box 60, and a partition wall 64 is provided within the intake air-dispending box 60 to extend vertically. Thus, the inside of the intake air-dispending box 60 is divided into a left dispensing chamber 63L and a right dispensing chamber 63R, which communicate with the intake air inlet 61. A guide wall 67 is connected to the partition wall 64 for diverting air entering the intake air inlet 61 into the left and right dispensing chambers 63L and 63R.

A plurality of left intake branch pipes 65L and a plurality of right intake branch pipes 65R are integrally formed on a front wall of the intake air-dispending box 60 facing the valley 56 to communicate with the left and right dispensing chambers 63L and 63R, respectively. A single connecting flange 66 is integrally formed at downstream ends of the left and right intake branch pipes 65L and 65R to connect the intake branch pipes 65L and 65R to one another and bolted to the connecting flanges 59L and 59R of the left and right intake pipes 58L and 58R.

A funnel 65*f* is formed at an upstream end of each of the left intake branch pipes 65L and opens leftwards into the intake dispensing box 60, and a funnel 65*f* is formed at an upstream end of each of the right intake branch pipes 65R and opens rightwards into the intake dispensing box 60. Each of the funnels 65*f* contributes to the alleviation of a resistance in the corresponding intake branch pipe 65L, 65R, while ensuring an effective length of the corresponding intake branch pipe 65L, 65R.

Referring to FIGS. 3, 7 to 9 and 10 the connecting flange 62 having the intake air inlet 61 assumes a polygonal shape (a square shape in the illustrated embodiment), and a nut 68 is embedded in a front face of each of corners of the connecting flange 62. A connecting flange 69 formed at a downstream end of the throttle body 54 is superposed on a front end face of the connecting flange 62, and the connecting flanges 62 and 69 are coupled to each other by threadedly fitting a plurality of bolts 70 inserted through the connecting flange 69 into the nuts 68.

A plurality of lightening recesses 71 are defined in the front end face of the connecting flange 62, and a plurality of reinforcing ribs 72 are integrally formed on a back of the connecting flange 62 to extend on an outer surface of the intake air-dispensing box 60. Thus, a neck of the connecting flange 62 can be reinforced, while providing a reduction in weight of the connecting flange 62, and particularly the disposition of the reinforcing ribs 72 at locations corresponding to the embedded nuts 68 is effective for effectively reinforcing a connection of the connecting flange 62 to the throttle body 54.

A single or a plurality of valve bores 74 is or are provided in the partition wall 64 dividing the inside of the intake air-dispensing box 60 into the left and right dispensing chambers 63L and 63R to permit the dispensing chambers 63L and 63R to communicate directly with each other, and a single or a plurality of on-off valves 75 is or are supported on the partition wall 64 for opening and closing the valve bore or bores 74.

Thus, during operation of the engine E, air flowing into the first air intake port 47 flows downwards through the ventilating duct 49; is released into the lower portion of the engine room 23 and then flows toward the left and right inlets 52, 52 in the intake silencer 51 provided at an upper location. During this time, water drops contained in the air are separated from the air and dropped and hence, is prevented from entering into the intake silencer 51.

On the other hand, during operation of the generator 45, a cooling fan is rotated within the generator 45 and hence, the air flowing into the second air intake port 48 flows upwards through the ventilating passage 50 into cooling-air inlets 76 provided in the upper portion of the generator 45 to cool the inside of the generator 45, and then flows out of cooling-air outlets 77 provided in the lower portion of the generator 45. Thereafter, this air flows toward the left and right inlets 52, 52 in the intake silencer 51.

The air flowing into the left and right inlets 52, 52 are joined with each other within the silencer 51, and such air flows out of the outlet 53 through the intake passage 54*a* in the throttle body 54 toward the intake air inlet 61 in the intake air-dispensing box 60. During this process, the amount of air drawn into the engine E is controlled in the intake passage 54*a* in accordance with the opening degree of the throttle valve 55.

In a low-speed operational range of the engine E, the on-off valve 75 within the intake air-dispensing box 60 is in a closed state, and the air flowing into the intake air inlet 61 is diverted into the left and right dispensing chambers 63L and 63R extending vertically. The air diverted into the left dispensing chamber 63L is further diverted into the plurality of left intake branch pipes 65L and passed via the left intake pipes 58L through the intake ports 57L in the left bank 26L into the corresponding cylinder bores 28L. The air diverted into the right dispensing chamber 63R is further diverted into the plurality of right intake branch pipes 65R and passed via the right intake pipes 58R through the intake ports 57R in the right bank 26R into the corresponding cylinder bores 28R.

In the low-speed operational range of the engine E, the left dispensing chamber 63L and the right dispensing chamber 63R, into which the funnels 65*f* of the left and right intake branch pipes 65L and 65R open, excluding portions communicating with the intake air inlet 61, are disconnected from each other by the on-off valve 75 which is in the closed state. Therefore, two resonant supercharging intake systems causing no air-drawing interference with each other are formed, which comprise an intake system extending from the left dispensing chamber 63L to the intake port 57L in the left bank 26L and an intake system extending from the right dispensing chamber 63R to the intake port 57R in the right bank 26R. Moreover, the natural vibration of each of the resonant supercharging intake systems is set to substantially accord with the opening/closing cycle of the intake valve in each of the banks 26L and 26R in the low-speed operational range of the engine E. Therefore, a resonant supercharging effect can be exhibited effectively, thereby increasing the intake air charging efficiency in the low-speed operational range of the engine and providing an enhancement in outputting performance.

The on-off valve 75 within the intake air-dispensing box 60 is opened, whereby the left and right dispensing chambers 63L and 63R communicate with each other through the valve bore or bores 74 to form a single surge tank having a large capacity, and the funnels 65*f* of the left and right intake branch pipes 65L and 65R open into the surge tank. Therefore, the substantial length of the resonant intake system is reduced, whereby the natural vibration of the resonant intake system can be increased to accord with the opening/closing cycle of the intake valve in each of the banks 26L and 26R in a high-speed operational range of the engine E, and a resonant supercharging effect can be exhibited effectively, whereby the intake air charging efficiency in the high-speed operational range of the engine E can be increased to provide an enhancement in outputting performance.

Figure 8:
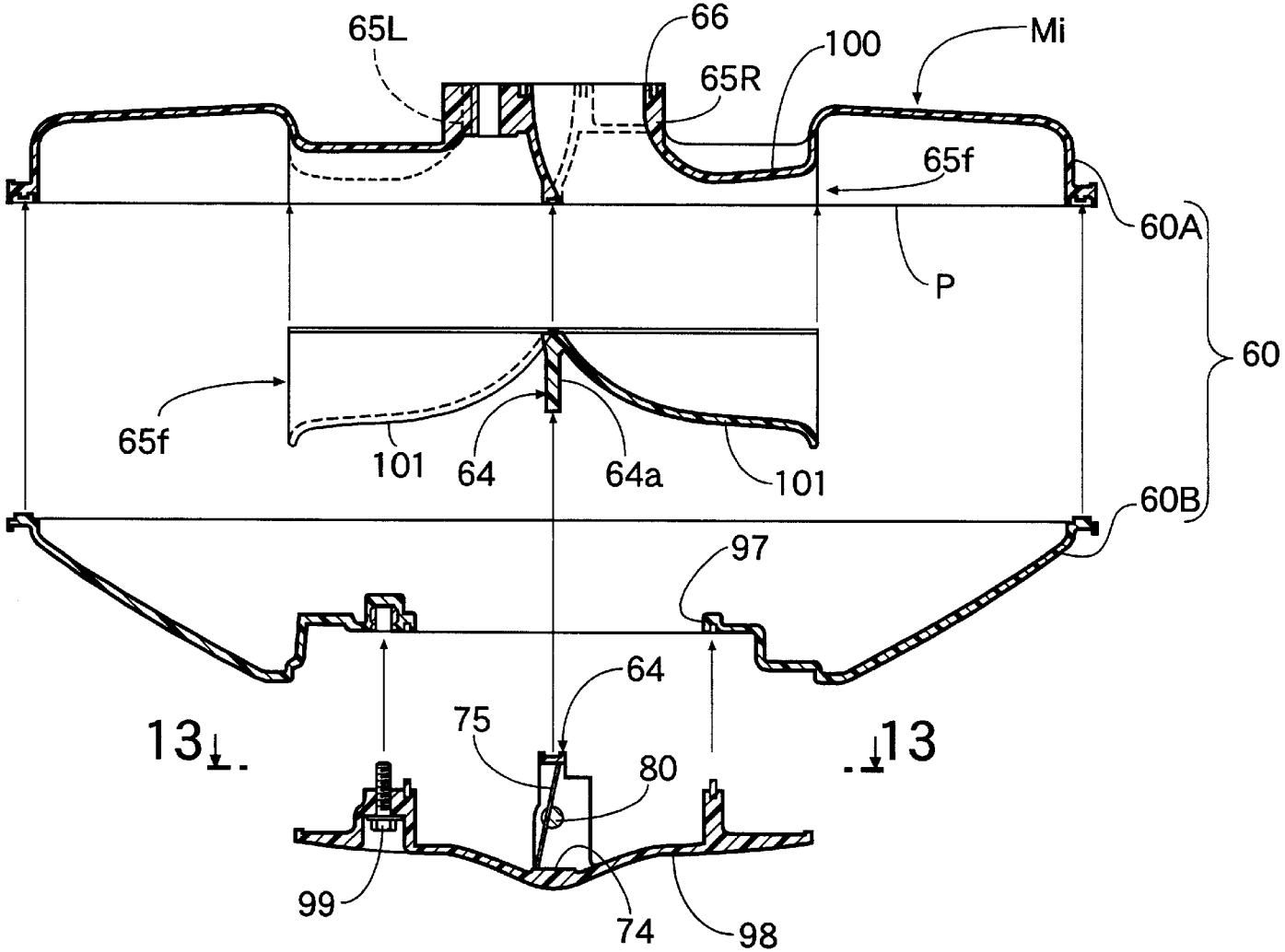
FIG. 8 is an exploded view similar to FIG. 7, but showing an intake manifold.
Figure 9:
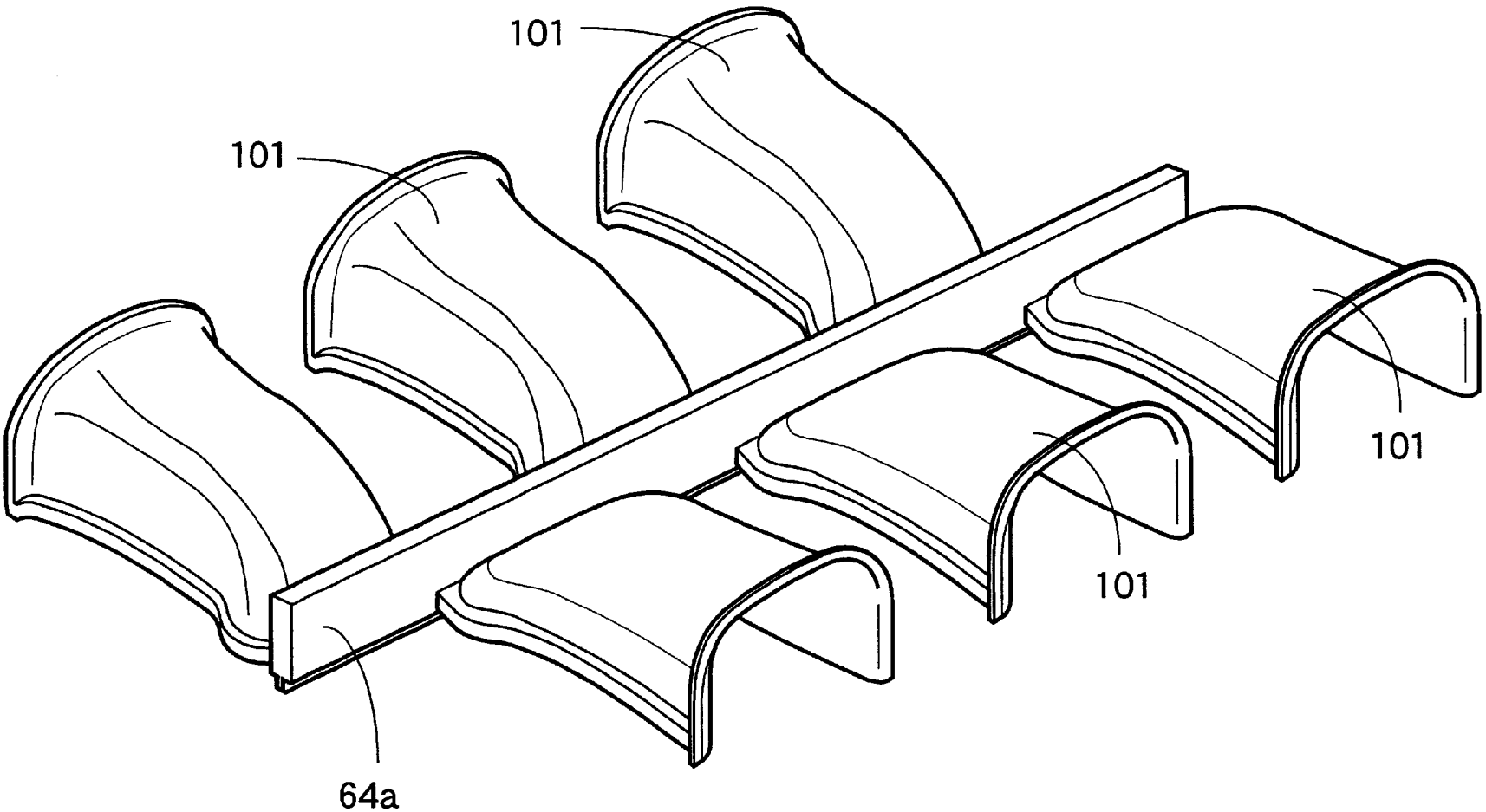
FIG. 9 is a perspective view of funnel segments in the intake manifold.
Figure 10:
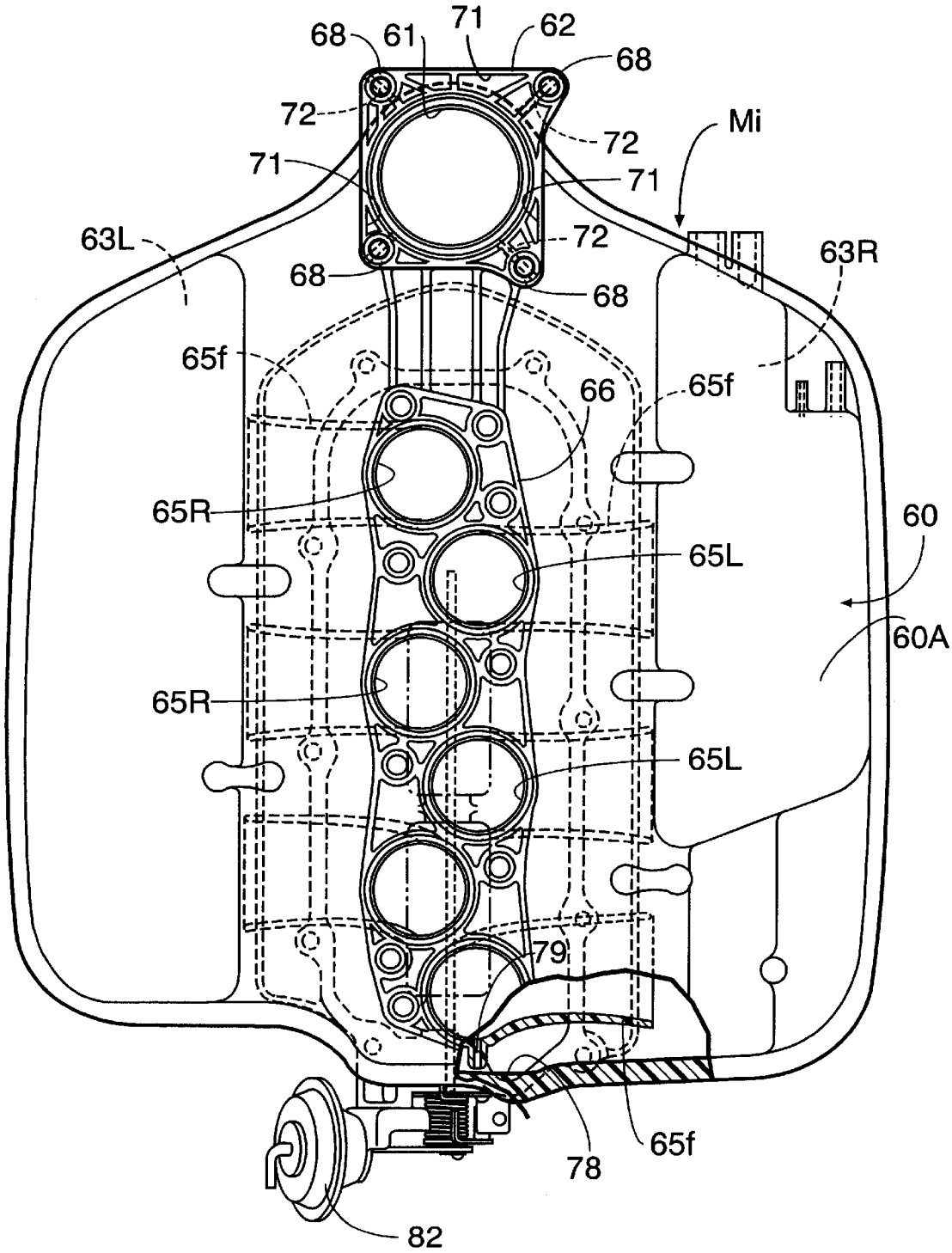
FIG. 10 is a sectional view taken along a line 10—10 in FIG. 7.

Referring to FIG. 8, an oil reservoir is provided in the form of a recess 78 in the bottom surface of the intake air-dispensing box 60. On the other hand, a fuel draw-up bore 79 is provided in the lowermost funnel 65*f* to extend downwards in order to permit an inner surface of the funnel 65*f* to communicate with the recess 78. Thus, even if fuel is accumulated on the bottom of the intake air-dispensing box 60, i.e., in the recess 78 as the fuel reservoir by an air blowing-back phenomenon during operation of the engine E, when a suction negative pressure is generated in the lowermost funnel 65*f*, the fuel draw-up bore 79 draws up the fuel by the action of the negative pressure and thus, the fuel is supplied into the corresponding cylinder bore 28L or 28R. Therefore, it is possible to prevent a loss of fuel.

The fuel flowing from each of the intake branch pipes 65L and 65R back to the intake air-dispensing box 60 is retained reliably in the recess 78 as the fuel reservoir and hence, it is also possible to prevent a loss of fuel due to the scattering of the fuel.

Further, the fuel draw-up bore 79 is provided in the funnel 65*f* of lowermost one of the intake branch pipes 65L and 65R arranged vertically and hence, the fuel accumulated in the recess 78 can be drawn up by the shortest fuel draw-up bore 79.

Figure 12:
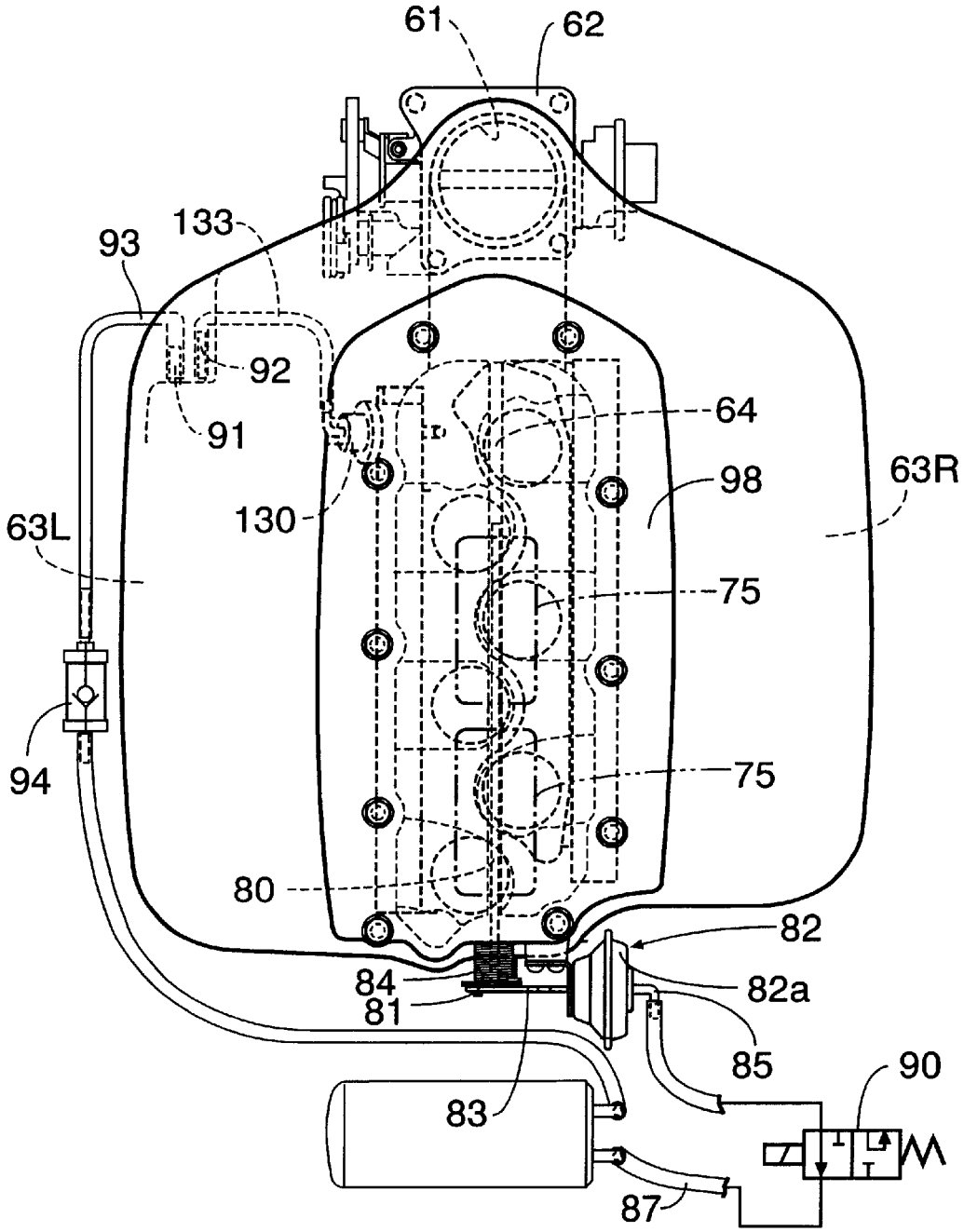
FIG. 12 is a view taken along a line 12—12 in FIG. 7.
Figure 13:
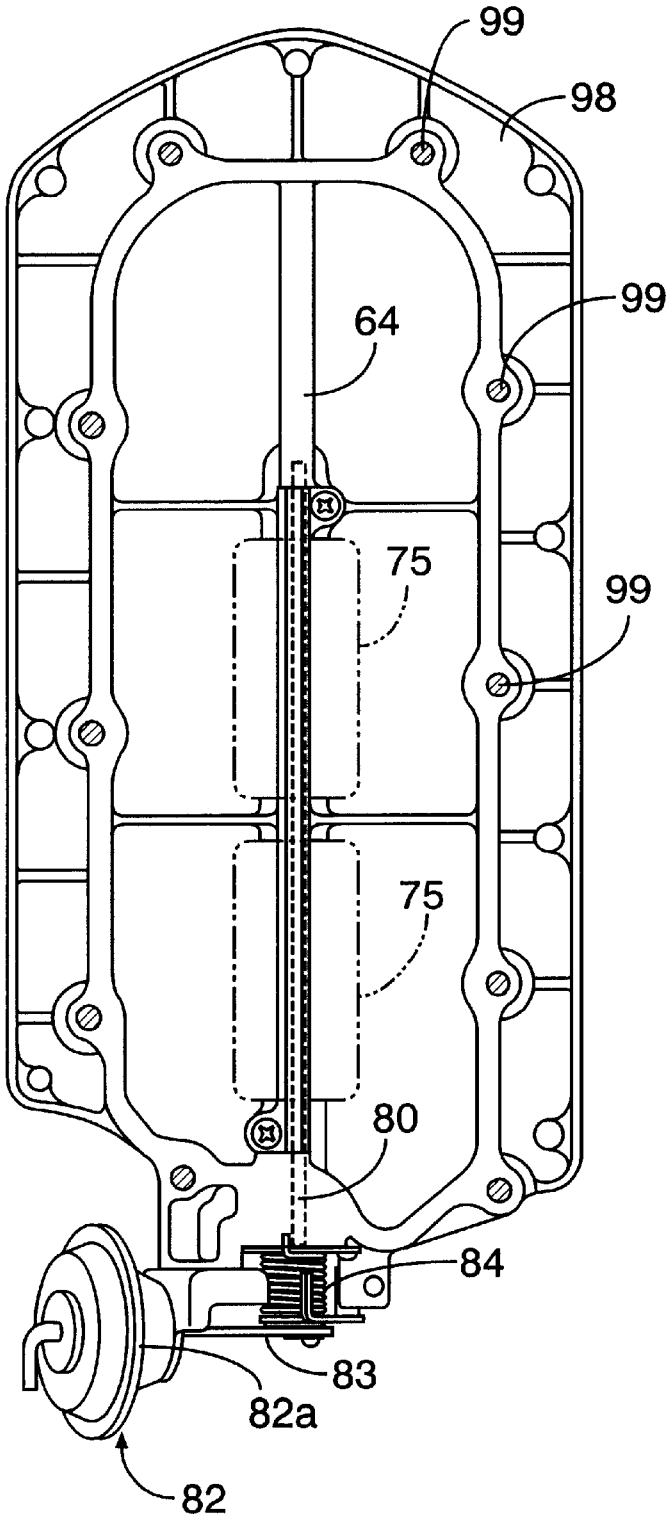
FIG. 13 is a sectional view taken along a line 13—13 in FIG. 2.

Referring to FIGS. 12 and 13, a valve shaft 80 secured to the on-off valve 75 is rotatably carried on the partition wall 64. An operating rod of a negative pressure actuator 82 is connected to an operating lever 81 fixedly mounted at one end of the valve shaft 80, and the operating lever 81 is biased by a return spring 84 in a direction to open the on-off valve 75. A casing 82*a* of the negative pressure actuator 82 is supported on an outer wall of the intake air-dispensing box 60. A diaphragm partitioning a negative pressure chamber and an atmospheric chamber is set within the casing 82*a,* so that when a negative pressure is introduced into the negative pressure chamber, the diaphragm is operated to pull the operating rod 83, thereby turning the operating lever 81 in the direction to close the on-off valve 75.

A negative pressure introduction pipe 85 is projectingly provided on the casing 82*a* of the negative pressure actuator 82 and connected to the negative pressure chamber, and a control valve 90 is incorporated in the middle of a negative pressure conduit 87 connecting the negative pressure introduction pipe 85 and a tank 86 to each other. The control valve 90 comprises a solenoid valve and is adapted to be excited in the low-speed operational range of the engine E to bring the negative pressure introduction pipe 85 into a conduction state and to be deexited in the high-speed operational range of the engine E to bring the negative pressure introduction pipe 85 into a blocked state and to release the negative pressure chamber in the negative pressure actuator 82 to the atmospheric air by the controlling conducted by an electronic control unit (not shown). Therefore, in the low-speed operational range of the engine E, the negative pressure actuator 82 is operated to close the on-off valves 75, and when the engine E is brought into the high-sped operational range, the negative pressure actuator 82 is brought into an inoperative state and hence, the on-off valves 75 are opened by a biasing force of the return spring 84.

A negative pressure conduit 93 leading to a first negative pressure take-out pipe 91 formed at an upper portion of the intake air-dispensing box 60 is connected to the negative pressure tank 86, and a check valve 94 is incorporated in the middle of the negative pressure conduit 93 and adapted to inhibit the back flow of a negative pressure from the negative pressure tank 86 toward the intake air-dispensing box 60. Therefore, during operation of the engine E, a suction negative pressure generated in the intake air-dispensing box 60 can be fed through the negative pressure conduit 93 and the check valve 94 to the negative pressure tank 86 and accumulated in the negative pressure tank 86.

As shown in FIGS. 2 and 4, the negative pressure tank 86 is disposed along with a subsidiary fuel tank 121 which will be described hereinafter in the auxiliary-placing space 27 defined between the upper surface of the rear portion of the mount case 1 and the left and right banks 26L and 26R.

Referring again to FIGS. 7 to 9, the intake air-dispensing box 60 is divided by a horizontal plane P into a first box half 60A located on a front side, i.e., on the side of the banks 26L and 26R, and a second box half 60B located on a rear side. The box halves 60A and 60B are formed separately from a synthetic resin. In this case, the connecting flange 62 having the intake air inlet 61 is integrally formed on the first box half 60A. Parting surfaces of the first and second box halves 60A and 60B are welded to each other in a vibration manner.

An opening 97 is provided in a central portion of a sidewall of the second box half 60B, and a lid plate 98 for closing the opening 97 is formed from a synthetic resin. In this case, a half of the partition wall 64 is integrally formed on the lid plate 98. The valve bore or bores 74 is or are defined in such half, and the on-off valve or valves 75 for opening and closing the valve bore or bores 74 is or are mounted to such half. The lid plate 98 is fastened to the second box half 60B by a bolt 99.

The left and right intake branch pipes 65L and 65R are comprised of a plurality of intake branch pipe bodies 100 integrally formed on the first box half 60A and each having a portion of the funnel 65*f*, and funnel segments 101 separated from the intake branch pipe bodies 100 by the plane P to constitute remaining portions of the funnels 65*f*. In this case, a connector 64*a* is integrally formed on all of the funnel segments 101 to constitute a portion of the partition wall 64. Namely, the funnel segments 101 and the connector 64*a* are formed integrally with each other.

To assemble the intake manifold Mi, the left and right intake branch pipe bodies 100 and the funnel segments 101 in the first box half 60A are first superposed and pressed on each other and welded to each other in a relative vibration manner. Then, the first box half 60A and the second box half 60B are likewise superposed on each other on the plane P and welded to each other in a similar vibration manner. Thereafter, the lid plate 98 is aligned with the second box half 60B and coupled to the latter by the bolt 99.

In this way, the first box half 60A and the second box half 60B, the intake branch pipe bodies 100 and the funnel segments 101 are welded in the vibration manner on the plane P. Therefore, the formation of the members can be facilitated, and in the welding of them, the pressing force on all the weld faces can be equalized reliably to equalize the weld margin, thereby stabilizing the welding strength. Thus, it is possible to provide enhancements in productivity and quality of the intake manifold Mi. In addition, the funnel segments 101 are connected integrally to one another by the connector 64*a* which is a portion of the partition wall 64 and hence, the funnel segments 101 can be formed at a time along with the connector 64*a* and welded easily in the vibration manner to the intake branch pipe bodies 100.

Moreover, the longitudinally flat intake air-dispensing box 60 is disposed in the proximity to the rear end faces of the left and right banks 26L and 26R, and the left and right intake branch pipes 65L and 65R are disposed to intrude into the valley 56 between the left and right banks 26L and 26R. Therefore, the intake manifold can be disposed in the narrow space between the banks 26L and 26R and the rear wall of the engine hood 33, thereby providing an enhancement in space efficiency of the engine room 23 and suppressing an increase in size of the engine hood 33.

The on-off valve 75 is supported on a portion of the partition wall 64 integral with the lid plate 98 and hence, after an assembly of the lid plate 98 and the on-off valve 75 is formed, the lid 98 is secured to the intake air-dispensing box 60, whereby the intake air-dispensing box 60 provided with the on-off valve 75 can be assembled with a good efficiency.

Figure 11:
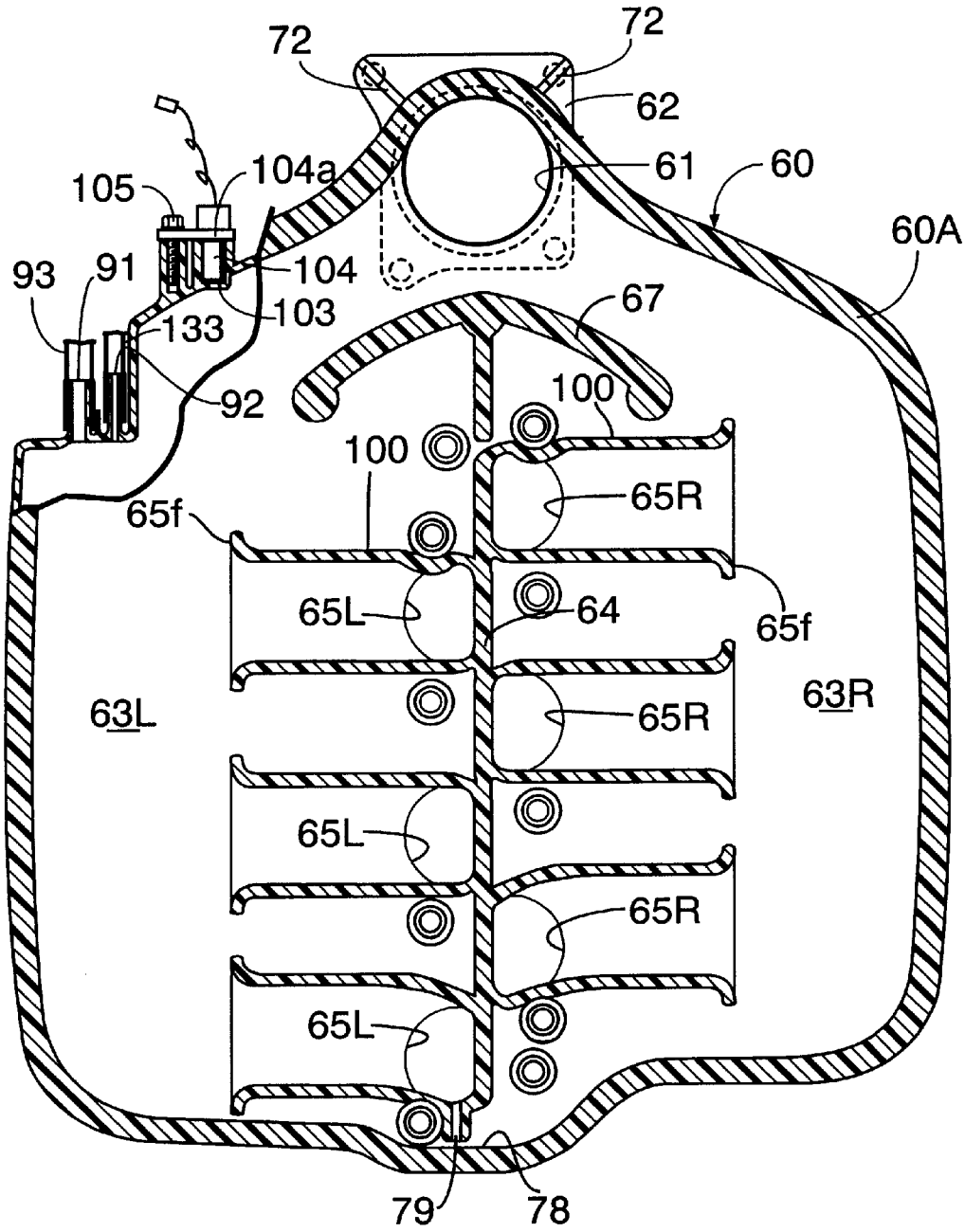
FIG. 11 is a sectional view taken along a line 11—11 in FIG. 7.

Referring to FIG. 11, a negative pressure detection bore 103 is provided in an upper wall of the intake air-dispensing box 60 to open into the intake air-dispensing box 60, and a suction negative pressure sensor 104 is fitted into the negative pressure detection bore 103. A mounting plate 104*a* included in the suction negative pressure sensor 104 is secured to the upper wall of the intake air-dispensing box 60 by a bolt 105. A lead wire leading to the electronic control unit (not shown) for controlling the amount of fuel injected into the engine, an igniting timing and the like is connected to an output terminal of the negative pressure sensor 104. Therefore, a suction negative pressure detected by the suction negative pressure sensor 104 is used to control the amount of fuel injected into the engine, the igniting timing and the like.

The negative pressure sensor 104 fitted in the negative pressure detection bore 103 directly detects a suction negative pressure generated in the intake manifold Mi and hence, the responsiveness of the negative pressure sensor 104 to a variation in suction negative pressure in the engine can be enhanced. Furthermore, the inside of the intake manifold Mi has a function as a surge tank and smoothens the pulsation of intake air in the engine and hence, the suction negative pressure sensor 104 can detect a correct suction negative pressure. Moreover, a long negative pressure conduit as used in the prior art is not required and hence, it is possible to provide enhancements in assemblability and maintenance of the engine.

The lead wire connected to the suction negative pressure sensor 104 is extremely thin and hence, cannot impede the assemblability and maintenance of the engine.

A fuel supply system will be described below with reference to FIGS. 7, and 14 to 20.

Electromagnetic fuel injection valves 110L and 110R are mounted to the intake pipes 58L and 58R in the left and right banks 26L and 26R for injecting fuel toward the intake valves in the corresponding banks 26L and 26R. A vertically prolonged left fuel rail 111L is mounted to the plurality of left fuel injection valves 110L for supplying fuel to the left fuel injection valves 110L, and a vertically prolonged right fuel rail 111R is mounted to the plurality of right fuel injection valves 110R for supplying fuel to the right fuel injection valves 110R. The fuel rails 111L and 111R are connected at their lower ends to each other by a communication pipe 112.

Each of the fuel rails 111L and 111R is comprised of a pipe formed of a light alloy by an extruding process, and includes a semi-cylindrical fuel passage 140 disposed offset from the center of the fuel rail 111L, 111R to one side, a plurality of injection valve-mounting bores 141 communicating with the fuel passage 140 and opening into a side opposite from the offset direction, and a mounting bore 142 disposed between the injection valve-mounting bores 141. The fuel injection valves 110L and 110R are mounted in the injection valve-mounting bores 141, and a bolt 143 for fastening each of the fuel rail 111L and 111R to the corresponding intake pipe 58L, 58R is inserted through the mounting bore 142.

A primary fuel pump 113 is mounted to one of the head cover 30L and mechanically driven by the camshaft 6L. A first fuel pipe 114 connected to an intake port in the primary fuel pump 113 is connected through a joint 115 to a fuel outlet pipe 117 extending from a fuel tank 116 disposed on the hull H. A first fuel filter 118 and a second fuel filter 119 are incorporated in the named order from the upstream side in the middle of the first fuel pipe 114. The first fuel filter 118 is adapted to remove water from the fuel, and the second fuel filter 119 is adapted to remove other foreign matters from the fuel.

A discharge port in the primary fuel pump 113 is connected to a fuel inlet in a subsidiary fuel tank 121 through a second fuel pipe 120. A known float valve is provided within the subsidiary fuel tank 121 and adapted to close the fuel inlet when the fuel oil level within the subsidiary fuel tank 121 is equal to or higher than a predetermined level. Therefore, during operation of the engine E, a given amount of fuel drawn up from the main fuel tank 116 by the primary fuel pump 113 is stored in the subsidiary fuel tank 121. A secondary fuel pump 122 is mounted to one side of the subsidiary fuel tank 121 for drawing up the fuel stored in the subsidiary fuel tank 121, and has a discharge port connected to an upper end of the right fuel rail 110R through a third fuel pipe 123. Therefore, high-pressure fuel discharged from the secondary fuel pump 122 fills the right fuel rail 110R from its upper end, and is then passed through the communication pipe 112 to fill the left fuel rail 110L from its lower end and supplied to the fuel injection valves 110L and 110R. In this manner, the left and right fuel rails 111L and 111R and the communication pipe 112 define a U-shaped fuel passage by cooperation with one another and hence, it is difficult for air bubbles to reside in the fuel passage, and it is possible to stabilize the amount of fuel injected from each of the fuel injection valves 110L and 110R.

Connecting structures shown in FIGS. 16 to 20 is used for connecting the fuel rails 111L and 111R with the third fuel pipe 123 and the communication pipe 112.

The connecting structures for connecting such members are identical to each other and hence, the connecting structure for connecting the communication pipe 112 with the left and right fuel rails 111L and 111R will be described below. A first connecting bore 127 having a circular shape different from the sectional shape of the fuel passage 140 is provided in each of the fuel rails 111L and 111R to open into a lower end face of the fuel rails 111L, 111R, and one of halves of a joint collar 125 made of a synthetic resin is liquid-tightly fitted to an inner peripheral surface of the first connecting bore 127. On the other hand, a terminal member 128 is connected to opposite ends of the communication pipe 112. The terminal member 128 is made of a synthetic resin and has a connecting pipe portion 128*a* which protrudes to one side and has a slip-off preventing rugged surface on its outer periphery and which is press-fitted into an end of the communication pipe 112. A second connecting bore 127' communicating with the connecting pipe portion 128*a* opens into an upper surface of the terminal member 128 opposed to the lower end face of the fuel rail 111L, 111R. The other half of the joint collar 125 is fitted into the second connecting bore 127' with a second seal member 126' interposed therebetween, and opposed surfaces of the fuel rail 111L, 111R and the terminal member 128 are mated to each other. The seal members 126 and 126' are previously fitted into an annular groove defined in an outer periphery of the joint collar 125. Each of the first and second connecting bores 127 and 127' is provided at its inner end with a step for preventing the axial voluntary movement of the joint collar 125.

Further, a distance collar 144 made of a metal is embedded in the terminal member 128 in parallel to the second connecting bore 127' and exposed at its opposite ends to the vertically opposite end faces of the terminal member 128, and the terminal member 128 is fastened to the lower end face of each of the fuel rails 111L and 111R by a single bolt 129 inserted through the collar 144.

By employing such connecting structures, the connection of the fuel rails 111L and 111R with the third fuel pipe 123 and the communication pipe 112 can be carried out simply and reliably.

Particularly, the terminal member 128 fitted over the other half of the joint collar 125 functions as a cap covering the lower end face of each of the fuel rails 111L and 111R and hence, a special closing member for closing the end face of the fuel rail as in the prior art is not required. The joint collar 125 fitted in the first and second connecting bores 127 and 127' not only permits each of the fuel rails 111L and 111R and the terminal member 128 to communicate with each other, but also prevents the rotation of the terminal member 128 by cooperation with the single bolt 129. Therefore, it is possible to fasten the terminal member 128 to each of the fuel rails 111L and 111R by the single bolt 129. Thus, it is possible to achieve reductions in number of parts for the connecting structure and number of assembling steps, leading to a reduction in cost.

In addition, the seal members 126 and 126' are interposed between the outer peripheral surface of the joint collar 125 and the inner peripheral surfaces of the first and second connecting bores 127 and 127', respectively and hence, even if there is a somewhat dislocation in the coaxial disposition of the first and second connecting bores 127 and 127', such dislocation can be absorbed by the deformation of the seal members 126 and 126' to ensure the liquid tightness around the joint collar 125.

Further, the terminal member 128 is made of a synthetic resin having a corrosion resistance and hence, even if seawater or the like is deposited to the terminal member 128, there is not a possibility that the terminal member 128 is corroded. Moreover, the distance collar 144 is embedded in a portion of the terminal member 128, which is clamped by the bolt 129 and hence, the clamping of the terminal member 128 of the synthetic resin to each of the fuel rails 111L and 111R can be conducted firmly by bearing the clamping force of the bolt 129 by the distance collar 144.

Figure 16:
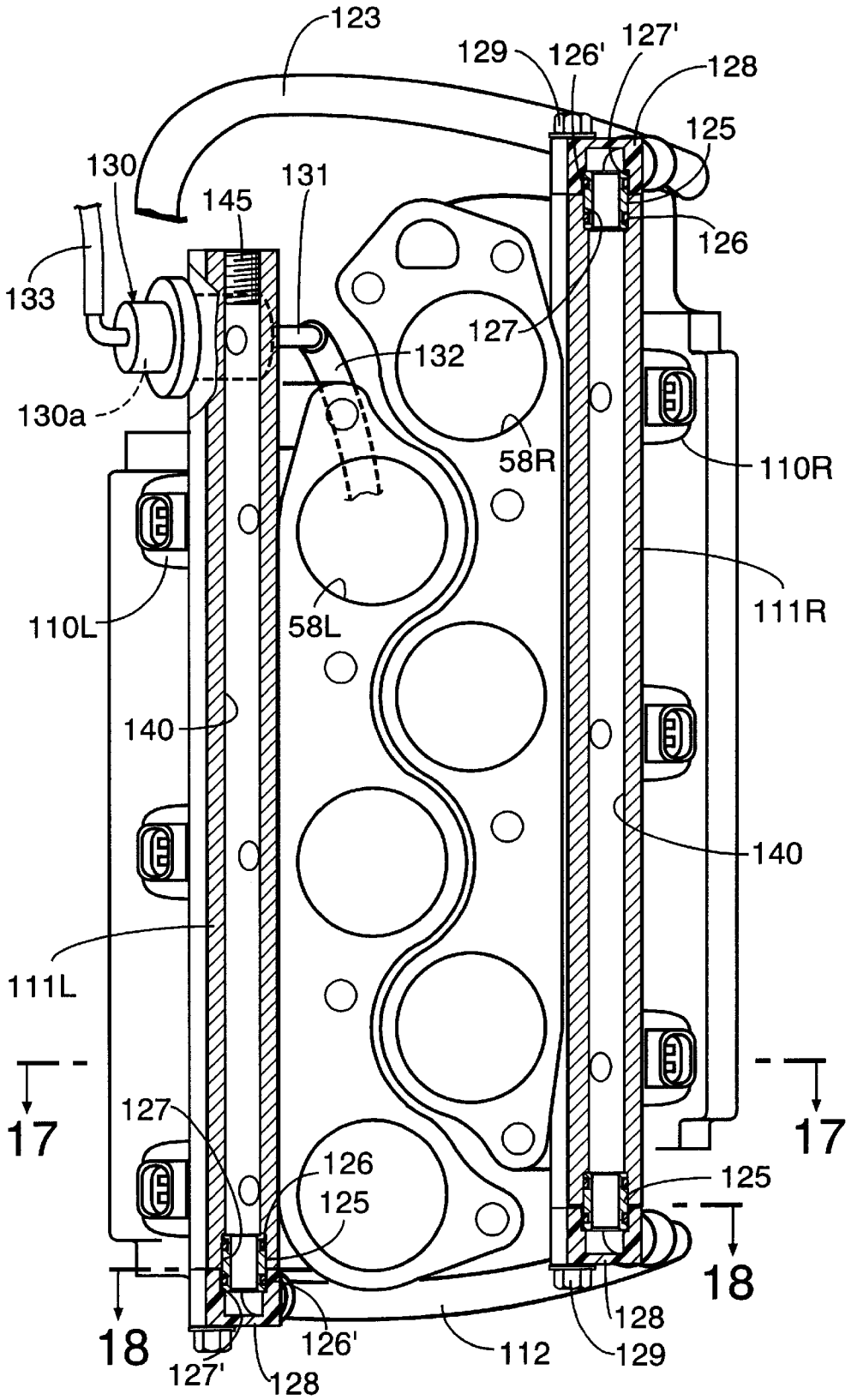
FIG. 16 is a vertical sectional view of fuel rails.
Figure 17:
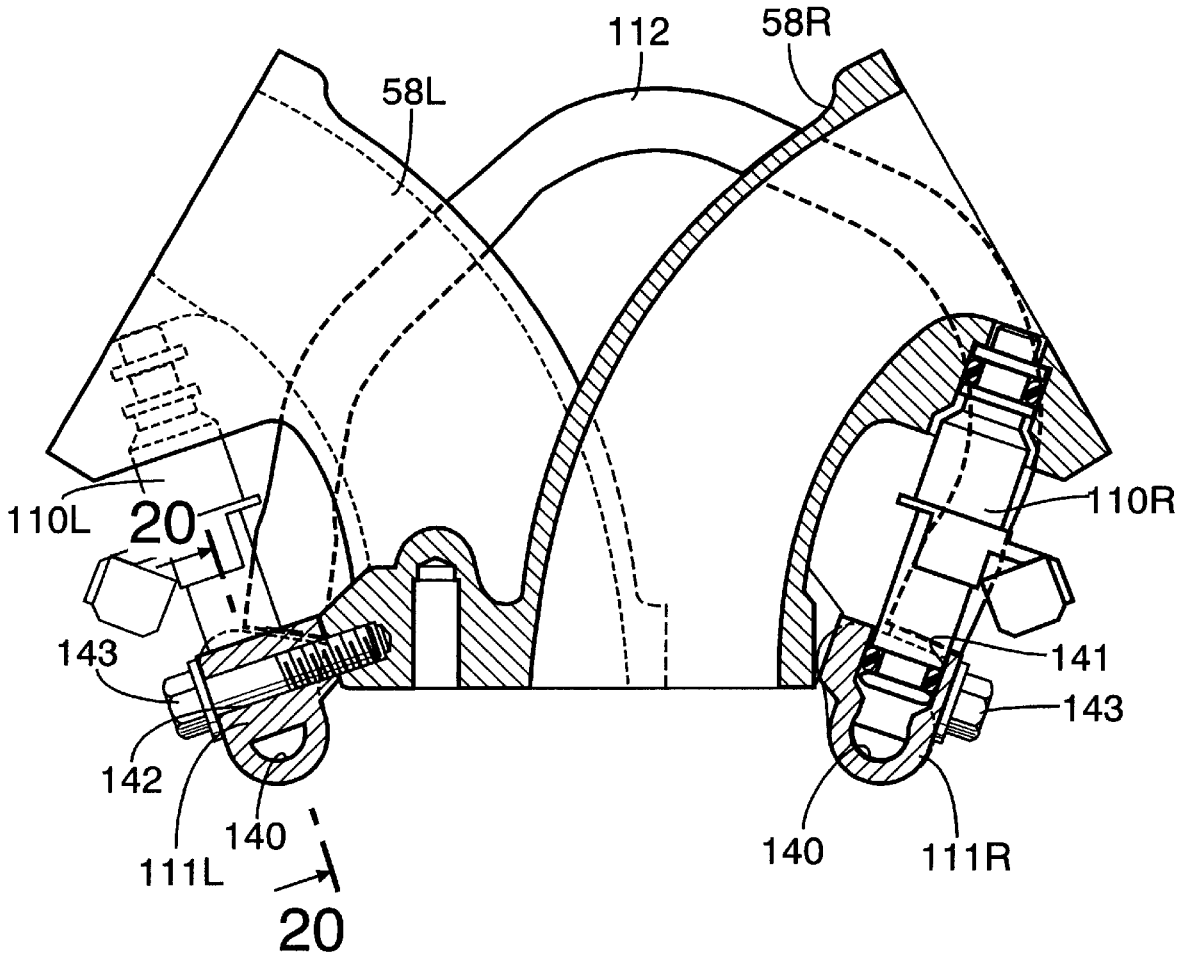
FIG. 17 is a sectional view taken along a line 17—17 in FIG. 16.
Figure 18:
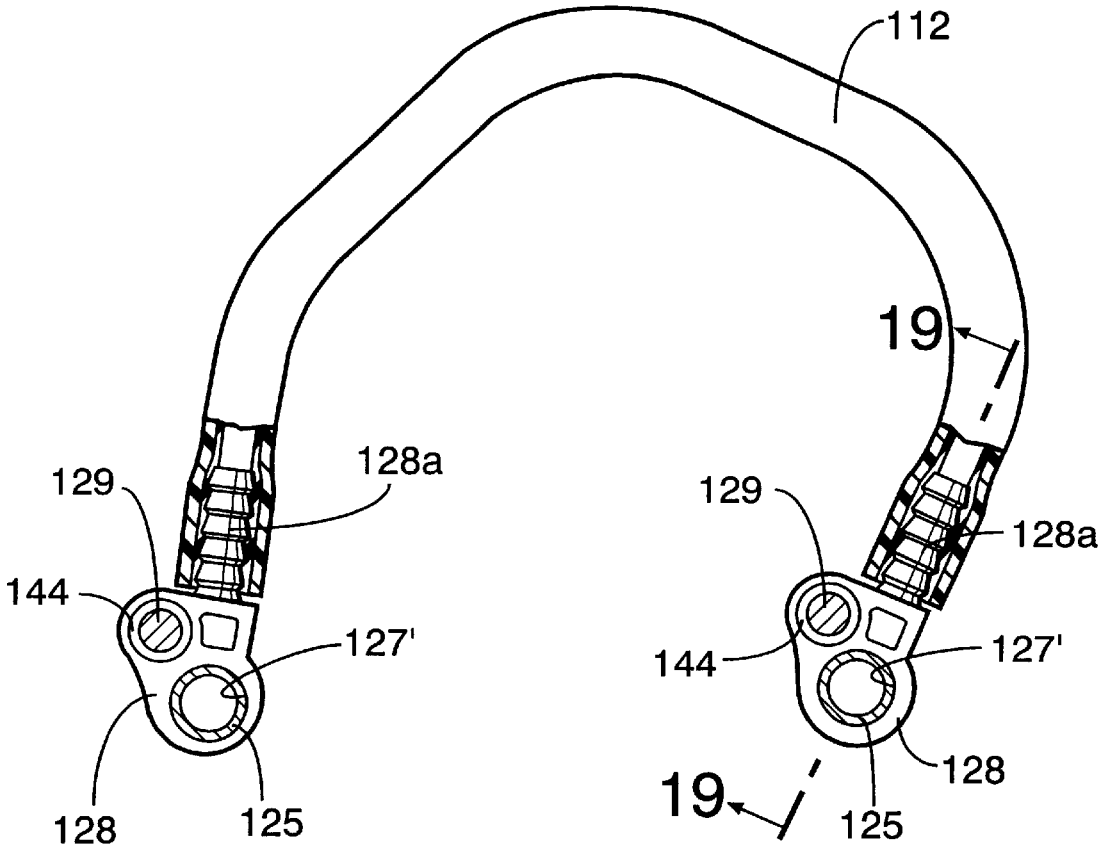
FIG. 18 is a sectional view taken along a line 18—18 in FIG. 16.
Figure 19:
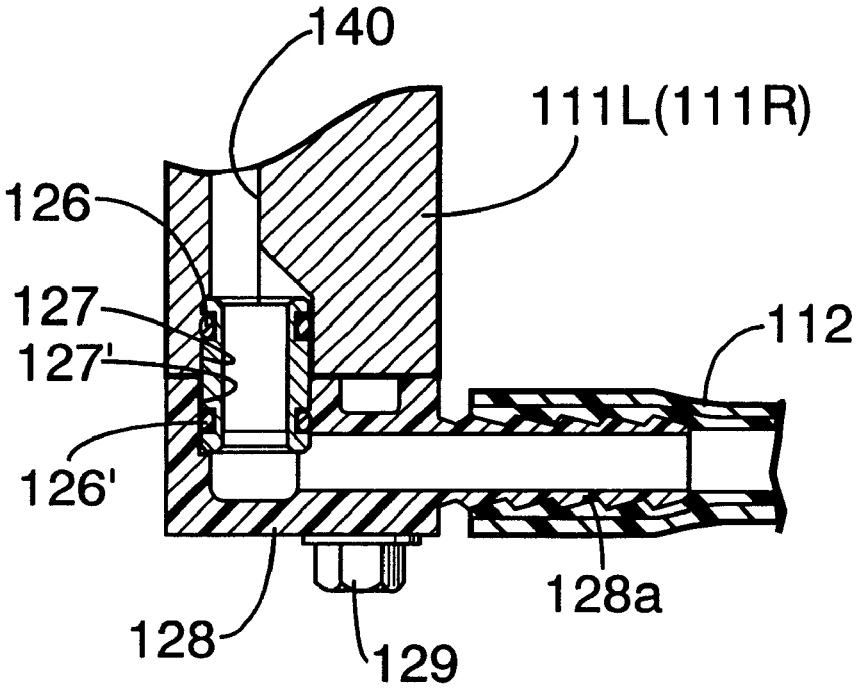
FIG. 19 is a sectional view taken along a line 19—19 in FIG. 18.
Figure 20:
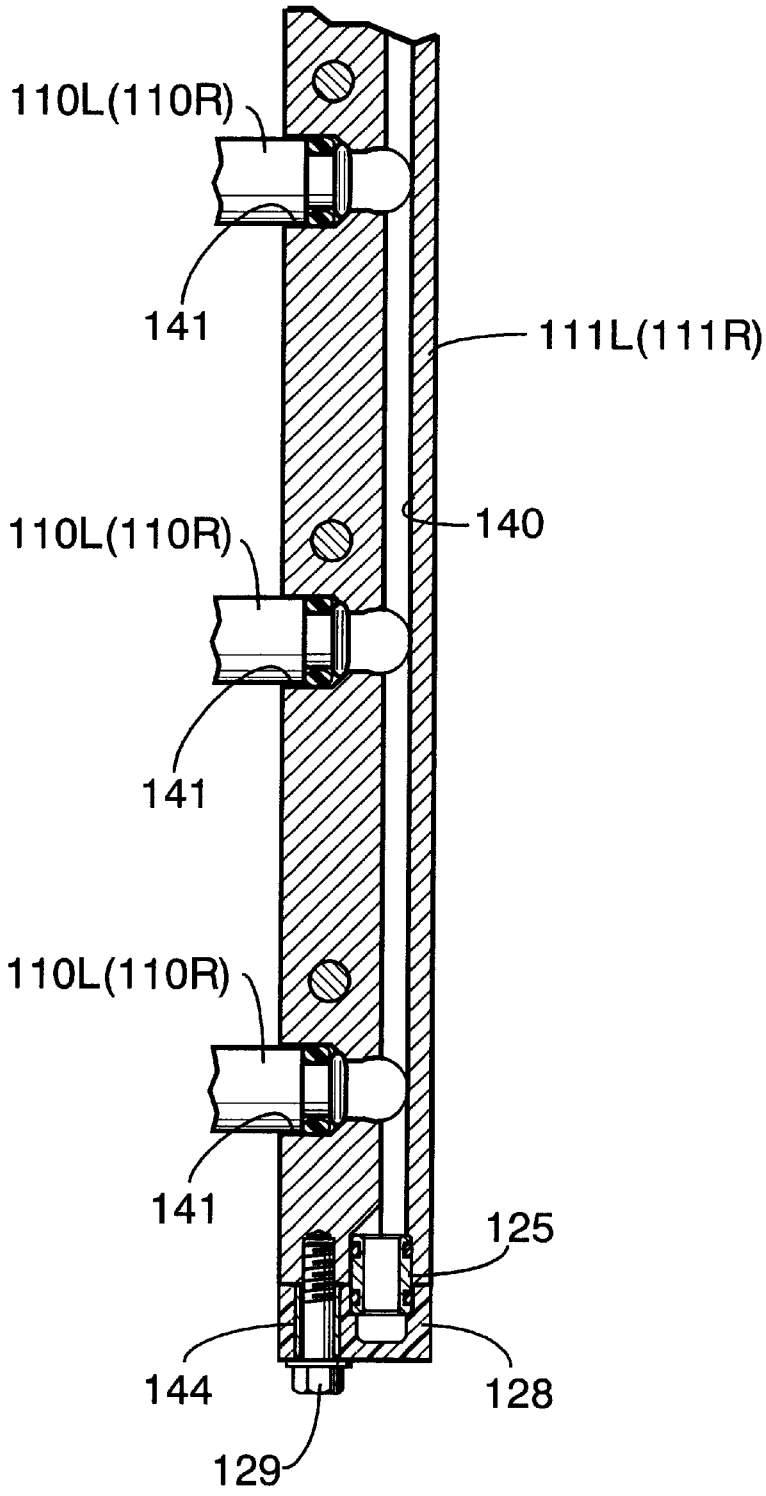
FIG. 20 is a sectional view taken along a line 20—20 in FIG. 17.

Referring to FIG. 16, a blind plug 145 is threadedly fitted into an upper end of the left fuel rail 111L to occlude the fuel passage 140. A fuel pressure regulator 130 is mounted to the left fuel rail 111L below the blind plug 145. The fuel pressure regulator 130 regulates the pressure in each of the fuel rails 111L and 111R, i.e., the pressure of fuel injected from each of the fuel injection valves 110L and 110R. A fuel return pipe 132 is connected to a surplus fuel outlet pipe 131 of the fuel pressure regulator 130 and opens at its terminal end into the subsidiary fuel tank 121. Therefore, the surplus fuel resulting from the pressure regulation by the fuel pressure regulator 130 is returned to the subsidiary fuel tank 121 through the fuel return pipe 132. The fuel pressure regulator 130 has a negative pressure chamber 130*a* for controlling the pressure of fuel injected in accordance with a suction negative pressure in the engine E, i.e., a load, and the second suction negative pressure take-out pipe 92 (see FIG. 11) of the intake air-dispensing box 60 is connected to the negative pressure chamber 130*a* through a negative pressure conduit 133.

An air vent pipe 134 is connected to the ceiling wall of the subsidiary fuel tank 121 to communicate with a space above the level of the fuel oil in the subsidiary fuel tank 121. The air vent pipe 134 once extends upwards and is then bent in an inverted U-shape at an upper portion of the engine E and opens into an annular space 24 (see FIG. 5) within the undercover 22. A fuel vapor collector 135 comprising a filter medium is incorporated in a rising path of the air vent pipe 134.

The inside of the subsidiary fuel tank 121 is breathed through the air vent pipe 134; and fuel vapor generated within the subsidiary fuel tank 121 at that time is collected by the fuel vapor collector 135, and liquefied fuel is returned to the subsidiary fuel tank 121.

Figure 14:
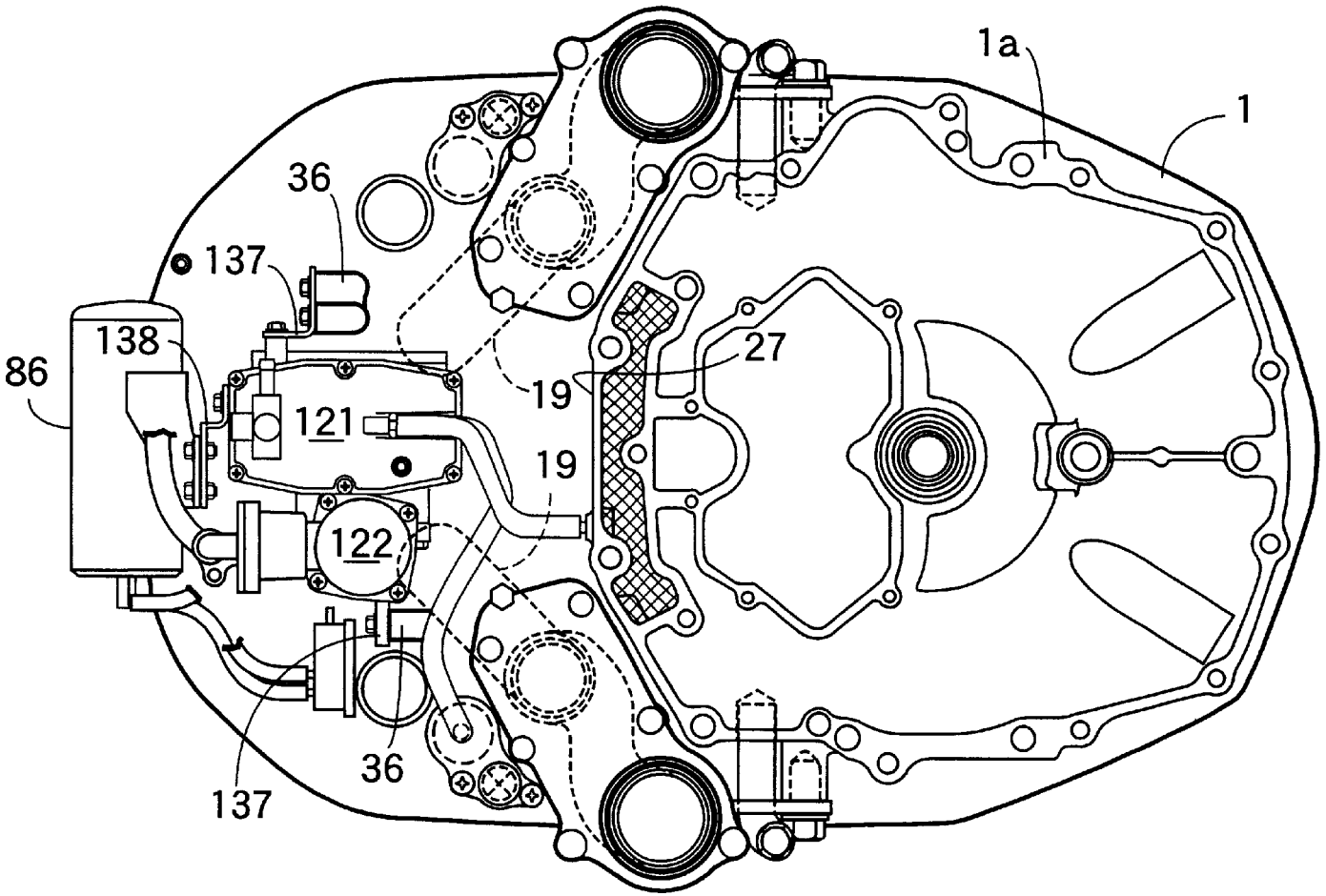
FIG. 14 is a sectional view taken along a line 14—14 in FIG. 2.
Figure 15:
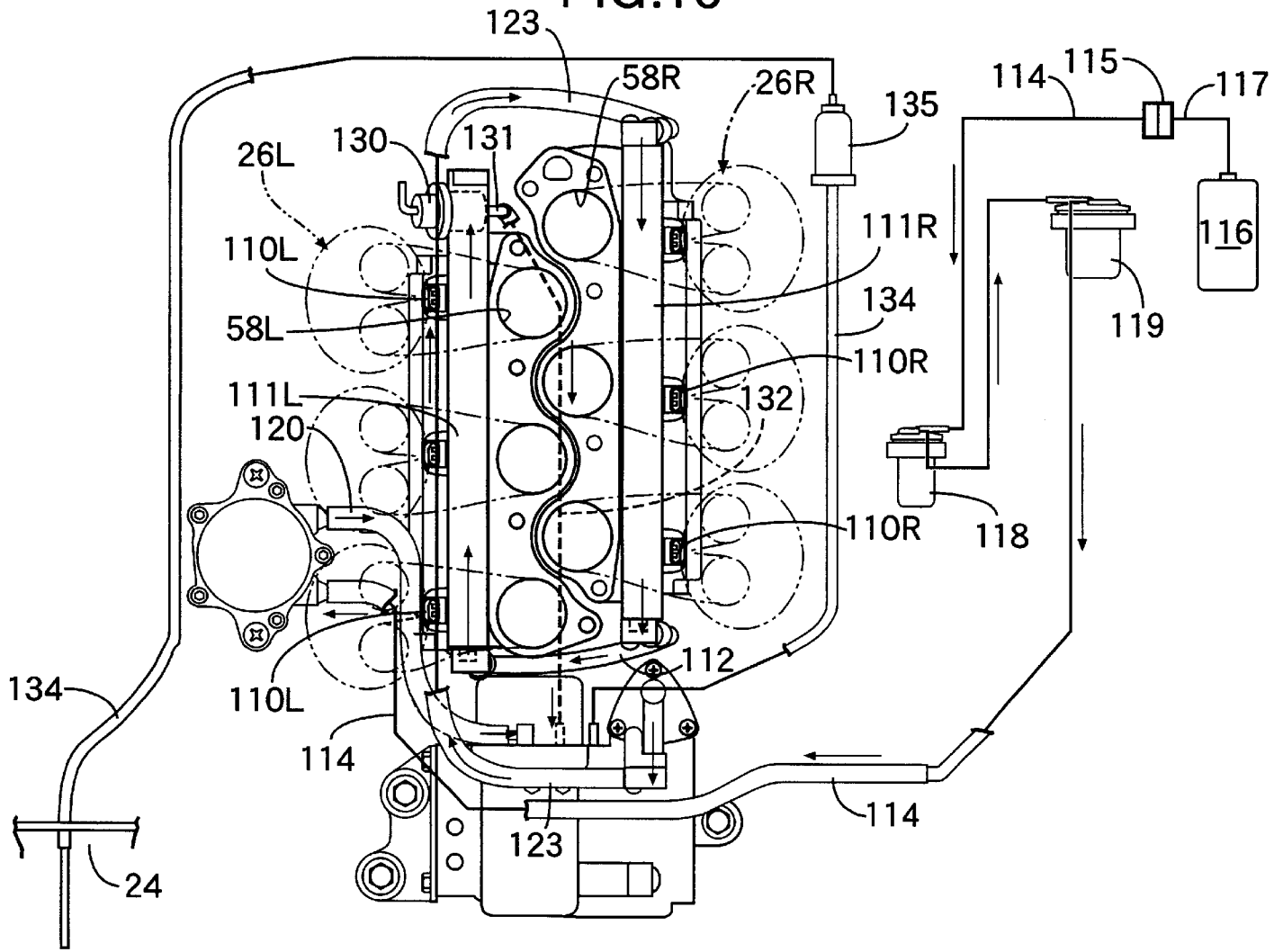
FIG. 15 is a diagram of the entire arrangement of a fuel supply system.

The subsidiary fuel tank 121 and the secondary fuel pump 122 are supported through a bracket 137 on a plurality of support struts 136 projectingly provided on the upper surface of the mount case 1 in the auxiliary-placing space 27 (see FIGS. 2 and 14). In this case, the left and right banks 26L and 26R are offset from each other at a predetermined distance in an axial direction of the crankshaft 24 and hence, there is a difference between depths of portions of the space 27 below the left and right banks 26L and 26R, and the vertically disposed secondary fuel pump 122 requiring a relatively high placing space is disposed in a deeper portion of the space 27. Thus, it is possible to enhance the space efficiency and to provide the compactness of the entire engine room 23.

The intake manifold Mi is disposed in the valley 56 between the left and right banks 26L and 26R, and the subsidiary fuel tank 121 and the secondary fuel pump 122 are disposed in the auxiliary-placing space 27 below the left and right banks 26L and 26R. Therefore, this reasonable disposition ensures that the engine room 23 has a relative low capacity, whereby the engine room 23 can be defined compactly.

Moreover, the subsidiary fuel tank 121 and the secondary fuel pump 122 located below the left and right banks 26L and 26R are difficult to receive heat of the left and right banks 26L and 26R and can inhibit the generation of fuel vapor to the utmost.

The subsidiary fuel tank 121 and the secondary fuel pump 122 integrally connected to each other constitute a single assembly and hence, it is easy to handle the assembly. Moreover, the assembly is supported on the support struts of the mount case 1 and hence, can be supported by a small number of the support struts, namely, it is possible to simplify the supporting structure for the subsidiary fuel tank 121 and the secondary fuel pump 122.

Furthermore, the subsidiary fuel tank 121 and the secondary fuel pump 122 need not be put into contact with the left and right banks 26L and 26R and hence, it is possible to avoid the transfer of heat from each of the banks 26L and 26R to the subsidiary fuel tank 121 and the secondary fuel pump 122 to prevent the overheating of the fuel within the subsidiary fuel tank 121 and the secondary fuel pump 122.

Although the embodiment of the present invention has been described in detail, it will be understood that the present invention is not limited to the above-described embodiment, and various modifications in design may be made without departing from the spirit and scope of the invention defined in the claims.

What is claimed is:

1. A fuel rail/fuel conduit connecting structure in an engine for an outboard engine system, the structure providing a connection between:

a fuel rail mounted to a plurality of fuel injection valves in the engine in order to dispense a fuel to the fuel injection valves; and fuel conduits for delivering and receiving the fuel to and from the fuel rail;

wherein a first connecting bore opens into an end face of the fuel rail and leads to a fuel passage in the fuel rail, and a second connecting bore opens into an end face of a synthetic resin terminal member having a connecting pipe portion which is projectingly provided on one side of the terminal member and to which an end of the fuel conduit is connected, the second connecting bore leading to the inside of the connecting pipe portion;

wherein one of halves of a joint collar is fitted to an inner peripheral surface of the first connecting bore with a first seal member interposed therebetween, and the other half of the joint collar is fitted to an inner peripheral surface of the second connecting bore with a second seal member interposed therebetween; and wherein the fuel rail and the fuel conduit are fastened to each other with their end faces aligned with each other by a single bolt.

2. A fuel rail/fuel conduit connecting structure in an engine for an outboard engine system according to claim 1, wherein a distance collar made of a metal is embedded in the terminal member, the bolt being inserted through the distance collar.

* * * * *